US009835963B2

(12) United States Patent
Inoue et al.

(10) Patent No.: US 9,835,963 B2
(45) Date of Patent: Dec. 5, 2017

(54) MAGNETIC ONE-COMPONENT DEVELOPER, DEVELOPER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Satoshi Inoue, Kanagawa (JP); Hiroyoshi Okuno, Kanagawa (JP); Yoshifumi Iida, Kanagawa (JP); Tomohito Nakajima, Kanagawa (JP); Yuka Zenitani, Kanagawa (JP); Yoshifumi Eri, Kanagawa (JP); Takeshi Iwanaga, Kanagawa (JP); Sakae Takeuchi, Kanagawa (JP); Yasuhisa Morooka, Kanagawa (JP); Yasuo Kadokura, Kanagawa (JP); Shunsuke Nozaki, Tokyo (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/205,951

(22) Filed: Jul. 8, 2016

(65) Prior Publication Data

US 2017/0227867 A1 Aug. 10, 2017

(30) Foreign Application Priority Data

Feb. 10, 2016 (JP) ..... 2016-024133

(51) Int. Cl.

| | |
|---|---|
| ***G03G 9/097*** | (2006.01) |
| ***G03G 9/083*** | (2006.01) |
| ***G03G 21/18*** | (2006.01) |
| ***G03G 15/08*** | (2006.01) |

(52) U.S. Cl.

CPC ..... *G03G 9/0837* (2013.01); *G03G 15/0822* (2013.01); *G03G 21/18* (2013.01)

(58) Field of Classification Search

CPC ..... G03G 9/09725

See application file for complete search history.

(56) References Cited

FOREIGN PATENT DOCUMENTS

| | | | |
|---|---|---|---|
| JP | 2003295509 | A | 10/2003 |
| JP | 2012215777 | A | 11/2012 |
| JP | 2013166667 | A | 8/2013 |
| JP | 2015143838 | A | 8/2015 |

*Primary Examiner* — Peter Vajda

(74) *Attorney, Agent, or Firm* — Oliff PLC

(57) ABSTRACT

A magnetic one-component developer includes magnetic toner particles containing a binder resin and a magnetic powder, and silica particles having a compression and aggregation degree of 60% or more and 95% or less and a particle compression ratio of 0.20 or more and 0.40 or less.

18 Claims, 3 Drawing Sheets

MAGNETIC ONE-COMPONENT DEVELOPER, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2016-024133 filed Feb. 10, 2016.

BACKGROUND (i) Technical Field

The present invention relates to a magnetic one-component developer, a developer cartridge, a process cartridge, an image forming apparatus, and an image forming method.

(ii) Related Art

A method for visualizing image information through electrostatic images by an electrophotographic method is currently used in various fields. The electrophotographic method includes forming, by charging and exposure, an electrostatic image of image information on the surface of an image holding member (photoreceptor) and developing a toner image on the surface of the photoreceptor with a developer containing a toner, transferring the toner image to a recording medium such as paper, and further fixing the toner image to the surface of the recording medium to visualize as an image. Further, a magnetic one-component developer (magnetic toner) is known as the developer used in the electrophotographic method.

SUMMARY

In a magnetic one-component development system, a magnetic toner is required to have high flowability for realizing stable supply of the magnetic toner to an image holding member and uniformity of a magnetic toner layer, and the magnetic toner is required to have a high charging speed for realizing rapid charging with a layer regulating member.

However, even when a magnetic toner containing magnetic toner particles and silica particles as an external additive is used, in the case of external addition of the silica particles with high aggregation property, which are surface-treated with silicone oil, repeated formation of images with high density in an environment of high temperature and high humidity may cause image unevenness and blurring of a thin-line image when solid image and thin-line image are formed after the formation of high-density images.

According to an aspect of the present invention, there is provided a magnetic one-component developer including magnetic toner particles containing a binder resin and a magnetic powder, and an external additive containing at least silica particles having a compression and aggregation degree of 60% or more and 95% or less and a particle compression ratio of 0.20 or more and 0.40 or less.

BRIEF DESCRIPTION OF THE DRAWINGS

Exemplary embodiments of the present invention will be described in detail based on the following figures, wherein.

DETAILED DESCRIPTION

Figure 1:
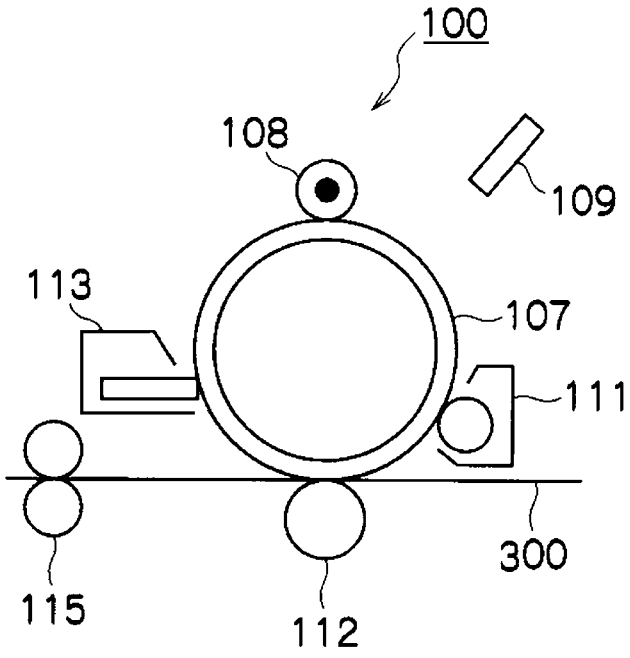
FIG. 1 is a schematic configuration diagram showing an example of an image forming apparatus according to an exemplary embodiment of the present invention.

An exemplary embodiment of the present invention is described below.

<Toner for Electrostatic Charge Image Development>

A magnetic one-component developer (hereinafter referred to as a "magnetic toner" or a "toner") according to an exemplary embodiment of the present invention includes magnetic toner particles (also referred to as "toner particles" hereinafter) containing a binder resin and a magnetic powder, and an external additive.

The external additive contains at least silica particles (hereinafter also referred to as "specific silica particles") having a compression and aggregation degree of 60% or more and 95% or less and a particle compression ratio of 0.20 or more and 0.40 or less.

In a magnetic one-component development system, a magnetic toner layer (magnetic one-component developer layer) is formed on the surface of a developer holding member (for example, a development roller) with a built-in magnet by the magnetic force of the magnet, and then the thickness of the magnetic toner layer is regulated by a layer regulating member (for example, a layer regulating blade) disposed in contact with the surface of the developer holding member. Hereinafter, a part which regulates the thickness of the magnetic toner layer is also referred to as a "layer regulating part". In addition, when the thickness of the magnetic toner image is regulated, the magnetic toner is charged by consolidation of the magnetic toner layer by the pressure applied from the layer regulating member.

In the magnetic one-component development system, therefore, the magnetic toner is required to have high flowability for realizing stable supply of the magnetic toner to the developer holding member and regulation of the more nearly uniform thickness of the magnetic toner layer, and the magnetic toner is required to have a high charging speed for realizing rapid charging with the layer regulating member.

It is known that for the purpose of realizing the high flowability and high charging speed, silica particles surface-treated with silicone oil (hereinafter referred to as "oil-treated silica particles") are externally added to the magnetic toner particles. The magnetic toner containing the magnetic toner particles and the oil-treated silica particles externally added thereto is considered to have a high charging speed because of the high aggregation property.

However, the oil-treated silica particles have lower flowability and lower dispersibility in the toner particles compared with hydrophobic silica particles (hereinafter referred to as "(agent other than oil)-treated hydrophobic silica particles") treated with a silane coupling agent, a silylating agent, or the like other than silicone oil. Therefore, the oil-treated silica particles hardly adhere in a nearly uniform state to the surfaces of the magnetic toner and thus aggregates may be formed. Therefore, in the present situation, the magnetic toner containing the magnetic toner particles and the oil-treated silica particles externally added thereto is unsatisfactory in flowability and it is required to improve the stable supply of the magnetic toner to the developer holding member and the uniformity of the magnetic toner layer on the surface of the developer holding member.

On the other hand, in the present situation, when the (agent other than oil)-treated hydrophobic silica particles are externally added to the magnetic toner particles in order to enhance the flowability of the magnetic toner, the flowability of the magnetic toner is enhanced, and the stable supply of the magnetic toner to the developer holding member and uniformity of the magnetic toner layer on the surface of the developer holding member are improved, but the charging speed is decreased.

In addition to this, the flowability of a toner may be decreased by a change in an external addition structure of the silica particles (the state of adhesion of the silica particles to the magnetic toner particles) due to stirring or the like in a development unit. Also, even when the oil-treated silica particles with the high aggregation property are externally added, a change in the external addition structure of the silica particles may cause deterioration in the aggregation property of the magnetic toner. An example of the cause of a change in the external addition structure is that the silica particles are moved and localized on the toner particles by stirring of the magnetic toner in the development unit, or that the silica particles are separated from the toner particles by stirring.

In particular, the toner flowability is decreased in a high-temperature high-humidity environment (for example, in an environment of 30° C. and 90% RH), and thus the repeated formation of high-density images (for example, solid images with an image density of 100%) decreases the stability of supply of toner to the developer holding member and further increases a low-charged toner. This increases the tendency of decreasing the stable supply of the magnetic toner to the developer holding member, the uniformity of the magnetic toner layer on the surface of the developer holding member, and the charging speed of the magnetic toner. Thus, when a thin-line image is formed after the formation of a high-density image, blurring may occur in the thin-line image. The reason for this is supposed as follows.

Therefore, the magnetic one-component developer according to an exemplary embodiment of the present invention contains specific silica particles externally added to the magnetic toner particles. In this case, when high-density images are repeatedly formed in a high-temperature high-humidity environment, unevenness of a solid image is suppressed, and further when a thin-line image is then formed, blurring of the thin-line image is suppressed. The reason for this is supposed as follows.

First, even in the use of a magnetic toner containing magnetic toner particles and usual silica particles externally added thereto, when high-density images are repeatedly formed in a high-temperature high-humidity environment, charge impartment to the toner does not catch up with a large toner consumption, and the low-charged toner on the developer holding member is increased, leading to blurring. On the other hand, when high-aggregation silica particles surface-treated silicone oil are externally added as the silica particles, the toner charging speed is affected in the layer regulating part and thus contributes to the suppression of the amount of the low-charged toner on the surface of the developer holding member, but the flowability of the toner is decreased. This is because the flowability of usual silicone oil-treatment silica particles is decreased by the influence of nonuniformity of silicone oil treatment, and thus the dispersibility of the silica particles on the toner surfaces is degraded. Consequently, the toner transport property of the developer holding member may be decreased. Also, the highly nonuniform treatment may produce an aggregated powder of the silica particles and thus may produce stripes in a layer forming part, that is, on the developer holding member. In addition, when a silicone oil component is transferred to the developer holding member, the toner layer formability on the developer holding member is decreased, and image unevenness and thin-line image blurring may occur when a solid image and a thin-line image are formed after the formation of high-density images.

On the other hand, the specific silica particles satisfying the compression and aggregation degree and the particle compression ratio within the ranges described above are silica particles having the property of high flowability and high dispersibility in the toner particles, and also high aggregation property and high adhesion to the toner particles.

Silica particles generally have high flowability but a low bulk density, and thus have low adhesion and the low aggregation property.

On the other hand, for the purpose of enhancing the flowability of silica particles and dispersibility in the toner particles, there is known a technique of treating the surfaces of the silica particles with a hydrophobic treatment agent. The technique improves the flowability of the silica particles and dispersibility in the toner particles, but the aggregation property remains low.

There is also known a technique of treating the surfaces of the silica particles with both the hydrophobic treatment agent and silicone oil. This technique improves the adhesion to the toner particles and improves the aggregation property. However, conversely, the flowability and dispersibility to the toner particles are easily decreased.

That is, it is said that the flowability of the silica particles and the dispersibility in the toner particles have a contrary relationship to the aggregation property and the adhesion to the toner particles.

On the other hand, as described above, the specific silica particles satisfying the compression and aggregation degree and the particle compression ratio within the ranges described above are good in four properties, such as flowability, dispersibility in the toner particles, the aggregation property, and adhesion to the toner particles.

Next, the meanings for controlling the compression and aggregation degree and the particle compression ratio of the specific silica particles within the ranges described above are described in order.

First, the meaning for controlling the compression and aggregation degree of the specific silica particles to 60% or more and 95% or less is described.

The compression and aggregation degree is an index which indicates the aggregation property of the silica particles and the adhesion to the toner particles. The index is shown by the degree of difficulty of disintegration of a silica particle compact when the silica particle compact is formed by compressing silica particles and is then dropped.

Therefore, there is a tendency that as the compression and aggregation degree increases, the bulk density of the silica particles easily increases and cohesive force (intermolecular force) increases, and the adhesion to the toner particles increases. A method for calculating the compression and aggregation degree is described in detail later.

Thus, the specific silica particles with the compression and aggregation degree controlled to be as high as 60% or more and 95% or less have good adhesion to the toner particles and good aggregation property. However, the upper limit of the compression and aggregation degree is 95% from the viewpoint of securing flowability and dispersibility in the toner particles while maintaining good adhesion to the toner particles and good aggregation property.

Next the meaning for controlling the particle compression ratio of the specific silica particles to 0.20 or more and 0.40 or less is described.

The particle compression ratio is an index indicating the flowability of the silica particles. Specifically, the particle compression ratio is shown by a ratio of a difference between the packed apparent specific gravity and loose apparent specific gravity of the silica particles to the packed apparent specific gravity ((packed apparent specific gravity−loose apparent specific gravity)/(packed apparent specific gravity)).

Thus, it is shown that the lower the particle compression ratio, the higher the flowability of the silica particles. Also, there is a tendency that as the flowability increases, the dispersibility in the toner particles also increases. A method for calculating the particle compression ratio is described in detail later.

Thus, the specific silica particles with the particle compression ratio controlled to be as low as 0.20 or more and 0.40 or less have good flowability and good dispersibility in the toner particles. However, the lower limit of the particle compression ratio is 0.20 from the viewpoint of improving the adhesion to the toner particles and the aggregation property while maintaining good flowability and dispersibility in the toner particles.

According to the above, the specific silica particles have the peculiar properties of high flowability, high dispersibility in the toner particles, the high cohesive force, and high adhesion to the toner particles. Therefore, the specific silica particles satisfying the compression and aggregation degree and particle compression ratio within the ranges described above have the properties of high flowability, high dispersibility in the toner particles, the high aggregation property, and high adhesion to the toner particles.

Next, the estimated function of the specific silica particles externally added to the toner particles is described.

First, the specific silica particles have high flowability and high dispersibility in the toner particles, and thus when externally added to the toner particles, the specific silica particles easily adhere in a nearly uniform state to the surfaces of the magnetic toner particles. Thus, once the specific silica particles have adhered to the magnetic toner particles, the specific silica particles are hardly moved on the magnetic toner particles and separated from the magnetic toner particles by the mechanical load due to stirring or the like in the development unit because of the high adhesion to the magnetic toner particles. That is, a change in the external addition structure little occurs. Therefore, the flowability of the magnetic toner particles is increased, and the high flowability is easily maintained.

On the other hand, the specific silica particles have the high aggregation property, and thus the cohesive force of the magnetic toner is also increased. In addition, the external addition structure in which the silica particles adhere in a nearly uniform state to the surfaces of the toner particles is hardly changed, and thus the cohesive force of the magnetic toner is easily maintained. That is, the charging speed of the magnetic toner is increased, and the high charging speed is easily maintained.

Therefore, even when high-density images (for example, solid images with an image density of 100%) are repeatedly formed in a high-temperature high-humidity environment (for example, an environment of 30° C. and 90% RH), the external addition structure of the specific silica particles is hardly changed, thereby suppressing decrease in the stable supply of the magnetic toner to the developer holding member, decrease in uniformity of the magnetic toner layer on the surface of the developer holding member, and decrease in the charging speed of the magnetic toner.

Therefore, it is estimated that the magnetic one-component developer according to the exemplary embodiment of the present invention suppresses solid image unevenness when high-density images are repeatedly formed in a high-temperature and high-humidity environment, and further suppresses blurring in a thin-line image when the thin-line image is then formed.

In the magnetic one-component developer (magnetic toner) according to the exemplary embodiment of the present invention, the specific silica particles preferably further have a degree of particle dispersion of 90% or more and 100% or less.

The meaning for controlling the degree of particle dispersion of the specific silica particles to 90% or more and 90% or less is described.

The degree of particle dispersion is an index indicating the dispersibility of silica particles. The index is shown by the degree of ease of dispersion of the silica particles in a primary particle state in the toner particles. Specifically, the degree of particle dispersion is shown by a ratio (measured coverage C/calculated coverage $C_o$) of measured coverage C of an adhesion object to calculated coverage $C_o$ wherein $C_o$ is the calculated coverage of toner particle surfaces with the silica particles, and C is the measured coverage.

Therefore, it is shown that the higher the degree of particle dispersion is, the more hardly the silica particles are aggregated, and the more easily the silica particles in the primary particle state are disperses in the toner particles. A method for calculating the degree of particle dispersion is described in detail later.

The dispersibility of the specific silica particles in the toner particles is further improved by controlling the degree of particle dispersion to be as high as 90% or more and 100% or less while controlling the compression and aggregation degree and the particle compression ratio within the ranges described above. Consequently, the flowability of the toner particles is further enhanced, and the high flowability is easily maintained.

In the magnetic one-component developer (magnetic toner) according to the exemplary embodiment of the present invention, as described above, the specific silica particles having the properties of high flowability, high dispersibility in the toner particles, the high aggregation property, and high adhesion to the toner particles are preferably silica particles with surfaces to which a siloxane compound having a relatively high weight-average molecular weight adheres. Specifically, the specific silica particles preferably have surfaces to which a siloxane compound having a viscosity of 1,000 cSt or more and 50,000 cSt or less adheres (the mount of surface adhesion is preferably 0.01% by mass or more and 5% by mass or less). The specific silica particles are produced by a method of surface-treating the surfaces of the silica particles with a siloxane compound having a viscosity of 1,000 cSt or more and 50,000 cSt or less so that the amount of surface adhesion is 0.01% by mass or more and 5% by mass or less.

The amount of surface adhesion is shown by a ratio to the silica particles (untreated silica particles) before the surface treatment of the surfaces of the silica particles. Hereinafter, the silica particles (that is, untreated silica particles) before the surface treatment are simply referred to as "silica particles".

The specific silica particles surface-treated with a siloxane compound having a viscosity of 1,000 cSt or more and 50,000 cSt or less so that the amount of surface adhesion is 0.01% by mass or more and 5% by mass or less are increased in flowability and dispersibility in the toner particles and also in the aggregation property and adhesion to the toner particles, and thus the compression and aggregation degree and the particle compression ratio easily satisfy the requirements described above. In addition, solid image unevenness and thin-line image blurring are easily suppressed. The reason for this is not clear, but the conceivable reason is as follows.

When a siloxane compound having relatively high viscosity within the range described above is adhered in a small amount within the range described above to the surfaces of the silica particles, the function derived from the characteristics of the siloxane compound on the surfaces of the silica particles is exhibited. Although the mechanism of this is not clear, when the silica particles flow, the mold releasability due to the siloxane compound is easily exhibited by adhesion of the siloxane compound with relatively high viscosity in a small amount within the range. Alternatively, the force between particles is decreased due to the steric hindrance of the siloxane compound, and thus adhesion between the silica particles is decreased. Therefore, flowability of the silica particles and the dispersibility in the toner particles are further increased.

On the other hand, when the silica particles are pressed, long chains of the siloxane compound on the surfaces of the silica particles are entangled, and the closest packing property of the silica particles is increased, thereby increasing aggregation of the silica particles. In addition, the cohesive force of the silica particles due to entanglement of the long chains of the siloxane compound is considered to be released by flowing the silica particles. In addition, the adhesion to the toner particles is also increased by the long chains of the siloxane compound on the surfaces of the silica particles.

According the above, the specific silica particles with surfaces to which the siloxane compound having viscosity within the range described above adheres in a small amount within the range described above easily satisfy the requirements of the compression and aggregation degree and the particle compression ratio and easily satisfy the requirement of the degree of particle dispersion. The configuration of the magnetic one-component developer (magnetic toner) is described in detail below.

(Magnetic Toner Particles

The magnetic toner particles contain, for example, a binder resin and a magnetic powder. If required, the magnetic toner particles may contain a coloring agent, a mold releasing agent, other additives, etc.

—Binder Resin—

Examples of the binder resin include vinyl resins containing homopolymers of monomers or copolymers of combination of two or more of the monomers, such as styrenes (for example, styrene, para-chlorostyrene, α-methylstyrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like), ethylenically unsaturated nitriles (for example, acrylonitrile, methacrylonitrile, and the like), vinyl ethers (for example, vinyl methyl ether, vinyl isobutyl ether, and the like), vinyl ketones (for example, vinyl methyl ketone, vinyl ethyl ketone, vinyl isopropenyl ketone, and the like), olefins (for example, ethylene, propylene, butadiene, and the like).

Other examples of the binder resin include non-vinyl resins such as epoxy resins, polyester resins, polyurethane resins, polyamide resins, cellulose resins, polyether resins, modified rosin, and the like, a mixture of the non-vinyl resin and the vinyl resins, graft polymers produced by polymerizing the vinyl monomers in coexistence with any one of the non-vinyl resins.

These binder resins may be used alone or in combination of two or more.

The binder resin is preferably a polyester resin.

Examples of the polyester resin include known polyester resins.

The polyester resin is, for example, a condensation polymer of a polyhydric carboxylic acid and a polyhydric alcohol. The polyester resin used may be a commercial product or a synthesized product.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, the like), acid anhydrides thereof, and lower (for example, 1 to 5 carbon atoms) alkyl esters thereof. Among these, for example, aromatic dicarboxylic acids are preferred as the polyhydric carboxylic acid.

The polyhydric carboxylic acid may be a combination of dicarboxylic acid and a tri- or higher-hydric carboxylic acid having a crosslinked structure or branched structure. Examples of the tri- or higher-hydric carboxylic acid include trimellitic acid, pyromellitic acid, anhydrides thereof, lower (for example, 1 to 5 carbon atoms) alkyl esters thereof, and the like.

The polyhydric carboxylic acids may be used alone or in combination of two or more.

Examples of polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), aromatic diols (for example, bisphenol A ethylene oxide adduct, bisphenol A propylene oxide adduct, and the like). Among these, for example, aromatic diols and alicyclic diols are preferred as the polyhydric alcohol, and the aromatic diols are more preferred.

The polyhydric alcohol may be a combination of diol and a tri- or higher-hydric alcohol having a crosslinked structure or branched structure. Examples of the tri- or higher-hydric alcohol include glycerin, trimethylolpropane, and pentaerythritol.

The polyhydric alcohols may be used alone or in combination of two or more.

The polyester resin preferably has a glass transition temperature (Tg) of 50° C. or more and 80° C. or less, and more preferably 50° C. or more and 65° C. or less.

The glass transition temperature is determined from a DSC curve obtained by differential scanning calorimetry (DSC). More specifically, the glass transition temperature is determined by "Extrapolation Glass Transition Onset Temperature" described in "Determination of Glass Transition Temperature" in JIS K 7121-1987 "Testing Methods for Transition Temperatures of Plastics".

The weight-average molecular weight (Mw) of the polyester resin is preferably 5,000 or more and 1,000,000 or less and more preferably 7,000 or more and 500,000 or less.

The number-average molecular weight (Mn) of the polyester resin is preferably 2,000 or more and 100,000 or less.

The molecular weight distribution Mw/Mn of the polyester resin is preferably 1.5 or more and 100 or less and more preferably 2 or more and 60 or less.

The weight-average molecular weight and number-average molecular weight are measured by gel permeation chromatography (GPC). The molecular weight is measured by GPC using GPC HLC-8120GPC manufactured by Tosoh Corporation as a measurement apparatus and a column TSK gel Super HM-M (15 cm) manufactured by Tosoh Corporation, and a THF solvent. The weight-average molecular weight and number-average molecular weight are calculated from the measurement results by using a molecular weight calibration curve formed by using monodisperse polystyrene standard samples.

The polyester resin can be produced by a known production method. Specifically, the polyester resin can be produced by, for example, a method in which reaction is performed at a polymerization temperature of 180° C. or more and 230° C. or less and, if required, in a reaction system under reduced pressure, the reaction is performed while the water and alcohol produced during condensation are removed.

When a monomer used as a raw material is insoluble or incompatible at the reaction temperature, a solvent having a high boiling point may be added as a solubilizing agent for dissolution. In this case, polycondensation reaction is performed while the solubilizing agent is distilled off. When a monomer having low compatibility is present, the monomer having low compatibility may be previously condensed with an acid or alcohol which is expected to be polycondensed with the monomer having low compatibility, and then polycondensed with a principal component.

Another preferred example of the binder resin is a styrene-(meth)acrylic resin.

The styrene-(meth)acrylic resin is a copolymer produced by copolymerizing at least a styrene-based polymerizable monomer (polymerizable monomer having a styrene skeleton) with a (meth)acrylic polymerizable monomer (polymerizable monomer having a (meth)acryloyl skeleton).

The expression "(meth)acrylic" represents both "acrylic" and "methacrylic".

Examples of the styrene-based polymerizable monomer include styrene, alkyl-substituted styrene (for example, α-methylstyrene, 2-methylstyrene, 3-methylstyrene, 4-methylstyrene, 2-ethylstyrene, 3-ethylstyrene, 4-ethylstyrene, and the like), halogen-substituted styrene (for example, 2-chlorostyrene, 3-chlorostyrene, 4-chlorostyrene, and the like), vinylnaphthalene, and the like. The styrene-based polymerizable monomers may be used alone or in combination of two or more.

Among these, styrene is preferred as the styrene-based polymerizable monomer in view of ease of reaction, ease of reaction control, and availability.

Examples of the (meth)acrylic polymerizable monomer include (meth)acrylic acid and (meth)acrylic acid esters. Examples of (meth)acrylic acid esters include (meth)acrylic acid alkyl esters (for example, methyl (meth)acrylate, ethyl (meth)acrylate, n-propyl (meth)acrylate, n-butyl (meth) acrylate, n-pentyl (meth)acrylate, n-hexyl (meth)acrylate, n-heptyl (meth)acrylate, n-octyl (meth)acrylate, n-decyl (meth)acrylate, n-dodecyl(meth)acrylate, n-lauryl (meth) acrylate, n-tetradecyl (meth)acrylate, n-hexadecyl (meth) acrylate, n-octadecyl (meth)acrylate, isopropyl (meth)acrylate, isobutyl (meth)acrylate, tert-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth)acrylate, cyclohexyl (meth)acrylate, tert-butyl cyclohexyl (meth) acrylate, and the like), (meth)acrylic acid aryl esters (for example, phenyl (meth)acrylate, biphenyl (meth)acrylate, diphenylethyl (meth)acrylate, tert-butylphenyl (meth)acrylate, terphenyl (meth)acrylate, and the like), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth)acrylamide, and the like. The (meth)acrylic polymerizable monomers may be used alone or in combination of two or more.

The copolymerization ratio (mass basis, styrene-based polymerizable monomer/(meth)acrylic polymerizable monomer) of the styrene-based polymerizable monomer to the (meth)acrylic polymerizable monomer is preferably, for example, 85/15 to 70/30.

The styrene-(meth)acrylic resin may have a crosslinked structure. The styrene-(meth)acrylic resin having a crosslinked structure is a crosslinked product produced by, for example, copolymerizing and crosslinking at least the styrene-based polymerizable monomer, the (meth)acrylic polymerizable monomer, and a crosslinkable monomer.

The crosslinkable monomer is, for example, a bi- or higher-functional crosslinking agent.

Examples of a bifunctional crosslinking agent include divinylbenzene, divinylnaphthalene, di(meth)acrylate compounds (for example, diethylene glycol di(meth)acrylate, methylene bis(meth)acrylamide, decanediol diacrylate, glycidyl (meth)acrylate, and the like), polyester-type di(meth) acrylate, 2-([1'-methylpropylideneamino]carboxyamino) ethyl methacrylate, and the like.

Examples of a polyfunctional crosslinking agent include tri(meth)acrylate compounds (for example, pentaerythritol tri(meth)acrylate, trimethylolethane tri(meth)acrylate, trimethylolpropane tri(meth)acrylate, and the like), tetra(meth) acrylate compounds (for example, tetramethylolmethane tetra(meth)acrylate, oligoester (meth)acrylate, and the like), 2,2-bis(4-methacryloxy polyethoxyphenyl)propane, diallyl phthalate, triallyl cyanurate, triallyl isocyanurate, triallyl trimellitate, diaryl chlorendate, and the like.

The copolymerization ratio (mass bass, crosslinkable monomer/total of monomers) of the crosslinkable monomer to the total of the monomers is preferably, for example, 2/1000 to 30/1000.

The glass transition temperature (Tg) of the styrene-(meth)acrylic resin is, for example, 50° C. or more and 75° C. or less, preferably 55° C. or more and 65° C. or less, and more preferably 57° C. or more and 60° C. or less in view of fixability.

The glass transition temperature is determined from a DSC curve obtained by differential scanning calorimetry (DSC). More specifically, the glass transition temperature is determined by "Extrapolation Glass Transition Onset Temperature" described in "Determination of Glass Transition Temperature" in JIS K 7121-1987 "Testing Methods for Transition Temperatures of Plastics".

The weight-average molecular weight of the styrene-(meth)acrylic resin is, for example, 30,000 or more and 200,000 or less, preferably 40,000 or more and 100,000 or less, and more preferably 50,000 or more and 80,000 or less in view of storage stability.

The weight-average molecular weight is measured by gel permeation chromatography (GPC). The molecular weight is measured by GPC using GPC•HLC-8120 GPC manufactured by Tosoh Corporation as a measurement apparatus and a column TSK gel Super HM-M (15 cm) manufactured by Tosoh Corporation, and a THF solvent. The weight-average molecular weight is calculated from the measurement results by using a molecular weight calibration curve formed by using monodisperse polystyrene standard samples.

The content of the binder resin is, for example, preferably 35% by mass or more and 75% by mass or less, more preferably 40% by mass or more and 70% by mass or less, and still more preferably 40% by mass or more and 60% by mass or less relative to the total of toner particles.

—Magnetic Powder—

Examples of the magnetic powder include powders of metals such as iron, cobalt, nickel, and the like, alloys thereof, metal oxides such as $Fe_3O_4$, $\gamma$-$Fe_2O_3$, cobalt-added iron oxide, and the like, ferrite such as MnZn ferrite, NiZn ferrite, and the like, magnetite, known magnetic materials such as hematite and the like.

The magnetic powder may be a magnetic powder treated with a surface treatment agent such as a silane coupling agent, a titanate coupling agent, or the like, a magnetic powder prepared by forming a coating layer of an inorganic material (a fluorine-based compound, an aluminum-based compound, or the like) on a magnetic powder, a magnetic powder prepared by forming a coating layer of an organic material on a magnetic powder, or the like.

The content of the magnetic powder is, for example, preferably 35% by mass or more and 55% by mass or less and more preferably 40% by mass or more and 50% by mass or less relative to the total of toner particles.

—Mold Release Agent—

Examples of the mold release agent include hydrocarbon wax, natural wax such as carnauba wax, rice bran wax, candelilla wax, and the like, synthetic or mineral/petroleum wax such as montan wax and the like, ester-based wax such as fatty acid esters, montanic acid esters, and the like, and the like. The mold release agent is not limited to these.

The melting temperature of the mold release agent is preferably 50° C. or more and 110° C. or less and more preferably 60° C. or more and 100° C. or less.

The melting temperature is determined from a DSC curve obtained by differential scanning calorimetry (DSC) according to "Melting Peak Temperature" described in "Determination of Melting Temperature" in JIS K 7121-1987 "Testing Methods for Transition Temperatures of Plastics".

The content of the mold release agent is, for example, preferably 1% by mass or more and 20% by mass or less and more preferably 5% by mass or more and 15% by mass or less relative to the total of toner particles.

—Other Additives—

Examples of other additives include known additive such as a coloring agent, a charging control agent, an inorganic power, and the like. These additives are contained as internal additives in the toner particles.

—Characteristics Etc. of Toner Particles—

The toner particles may be toner particles with a single-layer structure or a so-called core-shell structure including a core part (core particle) and a coating layer (shell layer) coating the core part.

The toner particles with a core-shell structure may include, for example, a core part containing the binder resin, the magnetic powder, and if required, other additives such as the coloring agent, the mold release agent, and the like, and a coating layer containing the binder resin.

The volume-average particle diameter (D50v) of the toner particles is preferably 2 μm or more and 10 μm or less and more preferably 4 μm or more and 8 μm or less.

Various average particle diameters and various particle size distribution indexes of the toner particles are measured by using Coulter Multisizer II (manufacture by Beckman Coulter Inc.) and ISOTON-II (manufactured by Beckman Coulter Inc.) as an electrolyte.

In measurement, 0.5 mg or more and 50 mg or less of a measurement sample is added to 2 ml of a 5% aqueous solution of a surfactant (sodium alkylbenzenesulfonate) used as a dispersant. The resultant mixture is added to 100 ml or more and 150 ml or less of the electrolyte.

The electrolyte in which the sample is suspended is dispersed by an ultrasonic disperser for 1 minute and a particle size distribution of particles having particle diameters within a range of 2 μm or more and 60 μm or less is measured by Coulter Multisizer II using an aperture having an aperture diameter of 100 μm. The number of particles sampled is 50000.

The measured particle size distribution is divided into particle size ranges (channels), and volume- and number-based cumulative distributions from the small-diameter side are formed. The cumulative 16% particle diameter is defined as volume particle diameter D16v and number particle diameter D16p, the cumulative 50% particle diameter is defined as volume-average particle diameter D50v and number-average particle diameter D50p, and the cumulative 84% particle diameter is defined as volume particle diameter D84v and number particle diameter D84p.

By using these values, the volume-average particle size distribution index (GSDv) is calculated as $(D84v/D16v)^{1/2}$, and the number-average particle size distribution index (GSDp) is calculated as $(D84p/D16p)^{1/2}$.

(External Additive)

The external additive includes the specific silica particles. The external additive may another additive other than the specific silica particles. That is, only the specific silica particles may be externally added to the toner particles, or the specific silica particles and another external additive may be externally added to the toner particles.

[Specific Silica Particles]

—Compression and Aggregation Degree—

The compression and aggregation degree of the specific silica particles is 60% or more and 95% or less. However, the compression and aggregation degree is preferably 65% or more and 95% or less and more preferably 70% or more and 95% or less from the viewpoint of securing flowability and dispersibility in the toner particles (particularly, from the viewpoint of suppressing solid image unevenness and thin-line image blurring) while maintaining the good aggregation property of the specific silica particles and good adhesion to the toner particles.

The compression and aggregation degree is calculated by a method described below.

A disk-shaped mold having a diameter of 6 cm is filled with 6.0 g of the specific silica particles. Next, the mold is compressed under a pressure of 5.0 t/cm$^2$ for 60 seconds by using a compression molding machine (manufactured by Maekawa Testing Machine Mfg Co., Ltd.) to produce a compressed disk-shaped compact (hereinafter a "compact before dropping") of the specific silica particles. Then, the mass of the compact before dropping is measured.

Next, the compact before dropping is placed on a sieving screen having an opening of 600 μm and dropped by using a vibration sieving machine (manufactured by Tsutsui Scientific Instruments Co., Ltd., part No. VIBRATING MVB-1) under the conditions including an amplitude of 1 mm and a vibration time of 1 minute. Consequently, the specific silica particles are dropped from the compact before dropping through the sieving screen, leaving the compact of the specific silica particles on the sieving screen. Then, the mass of the remaining compact of the specific silica particles (hereinafter referred to as a "compact after dropping") is measured.

The compression and aggregation degree is calculated from a ratio of the mass of the compact after dropping to the mass of the compact before dropping according a formula (1) below.

Compression and aggregation degree=(mass of compact after dropping/mass of compact before dropping)×100 Formula (1):

—Particle Compression Ratio—

The particle compression ratio of the specific silica particles is 0.20 or more and 0.40 or less. However, the particle compression ratio is preferably 0.24 or more and 0.38 or less and more preferably 0.28 or more and 0.36 or less from the viewpoint of securing flowability and dispersibility in the toner particles (particularly, from the viewpoint of suppressing solid image unevenness and thin-line image blurring) while maintaining the good aggregation property of the specific silica particles and good adhesion to the toner particles.

The particle compression ratio is calculated by a method described below.

The loose apparent specific gravity and packed apparent specific gravity of the silica particles are measured by using a powder tester (manufactured by Hosokawa Micron Ltd., part No. PT-S model). The particle compression ratio is calculated from a ratio of a difference between the packed apparent specific gravity and the loose apparent specific gravity of the silica particles to the packed apparent specific gravity according to formula (2) below.

Particle compression ratio=(packed apparent specific gravity−loose apparent specific gravity)/(packed apparent specific gravity) Formula (2):

The loose apparent specific gravity is a measured value derived by filling a container having a volume of 100 $cm^3$ with silica particles and weighing the container and represents a packing specific gravity in a state in which the specific silica particles are naturally dropped in the container. The packed apparent specific gravity represents an apparent specific gravity in a deaerated state in which the specific silica particles in the loose apparent specific gravity state are re-arranged and more closely packed by repeatedly applying impact (tapping) 180 times to the bottom of the container with a stroke length of 18 mm and a tapping rate of 50 times/min.

—Particle Dispersion Degree—

The particle dispersion degree of the specific silica particles is preferably 90% or more and 100% or less and more preferably 95% or more and 100% or less from the viewpoint of further improving dispersibility in the toner particles (particularly, from the viewpoint of layer formation stability on the developer holding member).

The particle dispersion degree is shown by a ratio of measured coverage C of the toner particles to calculated coverage $C_0$ and is calculated by using formula (3) below.

Particle dispersion degree=measured coverage $C$/calculated coverage $C_0$ Formula (3):

The calculated coverage $C_0$ of the surfaces of the toner particles with the specific silica particles can be calculated by formula (3-1) below using the volume-average particle diameter dt (m) of the toner particles, the average equivalent circle diameter da (m) of the specific silica particles, the specific gravity ρt of the toner particles, the specific gravity ρa of the specific silica particles, the weight Wt (kg) of the toner particles, and the weight Wa (kg) of the specific silica particles added.

Calculated coverage $C_0=\sqrt{3}/(2\pi)\times(\rho t/\rho a)\times(dt/da)\times(Wa/Wt)\times100(\%)$ Formula (3-1):

The measured coverage C of the surfaces of the toner particles with the specific silica particles can be calculated by formula (3-2) below using the signal intensities of silicon atoms derived from the specific silica particles measured for the toner particles alone, the specific silica particles alone, the toner particles coated with the specific silica particles (adhering) by an X-ray photoelectron spectrometer (XPS) ("JPS-9000MX": manufactured by JEOL Ltd.).

Measured coverage $C=(z-x)/(y-x)\times100(\%)$ Formula (3-2):

In the formula (3-2), x represents the signal intensity of silicon atoms derived from the specific silica particles of the toner particles alone, y represents the signal intensity of silicon atoms derived from the specific silica particles of the specific silica particles alone, and z represents the signal intensity of silicon atoms derived from the specific silica particles of the toner particles coated with the specific silica particles (adhering).

—Average Equivalent Circle Diameter—

The average equivalent circle diameter of the specific silica particles is preferably 40 nm or more and 200 nm or less, more preferably 50 nm or more and 180 nm or less, and still more preferably 60 nm or more and 160 nm or less from the viewpoint of improving the flowability, dispersibility in the toner particles, aggregation property, and adhesion to the toner particles with respect to the specific silica particles (particularly, from the viewpoint of suppressing solid image unevenness and thin-line image blurring).

With respect to the average equivalent circle diameter D50 of the specific silica particles, the primary particles after the specific silica particles are externally added to the toner particles are observed with a scanning electron microscope (SEM) apparatus (manufactured by Hitachi, Ltd.: S-4100) and an image is photographed. The image is introduced into an image analysis apparatus (LUZEX III, manufactured by Nireco Inc.), the areas of the primary particles are measured by image analysis, and equivalent circle diameters are calculated from the area values. The diameter (D50) at a cumulative frequency of 50% in volume-based distribution of the equivalent circle diameters is regarded as the average equivalent circle diameter D50. The magnification of the electron microscope is adjusted so that about 10 or more and 50 or less of specific silica particles are observed in a viewing field, plural viewing fields are observed for determining the equivalent circle diameter of the primary particles.

—Average Circularity—

The shape of the specific silica particles may be any one of a spherical shape and an irregular shape, but the average circularity of the specific silica particles is preferably 0.85 or more and 0.98 or less, more preferably 0.90 or more and 0.98 or less, and still more preferably 0.93 or more and 0.98 or less from the viewpoint of improving the flowability, dispersibility in the toner particles, aggregation property, and adhesion to the toner particles with respect to the specific silica particles (particularly, from the viewpoint of suppressing solid image unevenness and thin-line image blurring).

The average circularity of the specific silica particles is measured by a method described below.

First, the circularity of the specific silica particles is determined by observing, with a SEM apparatus, primary particles after the silica particles are external added to the toner particles, and "100/SF2" is calculated by a formula below based on plane image analysis of the primary particles.

$$\text{Circularity (100/SF2)}=4\pi\times(A/I^2) \quad \text{Formula:}$$

In the formula, I represents the circumference of the primary particle in an image, and A represents a projected area of the primary particle.

The average circularity of the specific silica particles is determined as circularity at a cumulative frequency of 50% in circularity distribution of 100 primary particles based on the plane image analysis.

Methods for measuring the characteristics (compression and aggregation degree, particle compression ratio, particle dispersion degree, and average circularity) of the specific silica particles of a toner are described below.

First, the external additive (specific silica particles) is separated from a toner as follows. The toner is placed and dispersed in methanol and stirred, and then the specific silica particles with a large diameter are separated from the surfaces of the toner particles by treatment in an ultrasonic bath. Then, the toner is sedimented by centrifugal separation, and only methanol in which the specific silica particles are dispersed is recovered. Then, the specific silica particles can be obtained by evaporating methanol. The characteristics described above are measured by using the separated specific silica particles.

When another external additive other than the specific silica particles is externally added, only the specific silica particles can be separated by setting weak ultrasonic treatment conditions because the ease of separation is determined by the particle diameter and specific gravity of an external additive, and the specific silica particles can be easily separated due to the large diameter.

The configuration of the specific silica particles is described below.

—Specific Silica Particles—

The specific silica particles are particles containing silica (that is, $SiO_2$) as a principal component and may be either crystalline or amorphous. The specific silica particles may be particles produced by using a silicon compound such as water glass, alkoxysilane, or the like as a raw material or particles produced by grinding quartz.

Examples of the specific silica particles include silica particles (hereinafter referred to as "sol-gel silica particles") produced by a sol-gel method, aqueous colloidal silica particles, alcoholic silica particles, fumed silica particles produced by a vapor-phase method, fused silica particles, and the like. Among these, sol-gel silica particles are preferred.

—Surface Treatment—

The specific silica particles are preferably surface-treated with a siloxane compound in order to control the compression and aggregation degree, particle compression ratio, and particle dispersion degree within the specific ranges described above.

The surface treatment method is preferably surface treatment of the surfaces of the silica particles with supercritical carbon dioxide in supercritical carbon dioxide. The surface treatment method is described later.

—Siloxane Compound—

The siloxane compound is not particularly limited as long as it has a siloxane skeleton in its molecular structure.

Examples of the siloxane compound include silicone oil and a silicone resin. Among these, silicone oil is preferred from the viewpoint of nearly uniform surface treatment of the surfaces of the silicone particles.

Examples of the silicone oil include dimethyl silicone oil, methyl hydrogen silicone oil, methyl phenyl silicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher-fatty acid ester-modified silicone oil, higher fatty acid amide-modified silicone oil, fluorine-modified silicone oil, and the like. Among these, dimethyl silicone oil, methyl hydrogen silicone oil, and amino-modified silicone oil are preferred.

The siloxane compounds may be used alone or in combination of two or more.

—Viscosity—

The viscosity (kinematic viscosity) of the siloxane compound is preferably 1000 cSt or more and 50000 cSt or less, more preferably 2000 cSt or more and 30000 cSt or less, and still more preferably 3000 cSt or more and 10000 cSt or less from the viewpoint of improving the flowability, dispersibility in the toner particles, aggregation property, and adhesion to the toner particles with respect to the specific silica particles (particularly, from the viewpoint of suppressing solid image unevenness and thin-line image blurring).

The viscosity of the siloxane compound is determined according to the following procedures. Toluene is added to the specific silica particles which are then dispersed by an ultrasonic disperser. Then, a supernatant is recovered. In this case, a toluene solution of the siloxane compound is a concentration of 1 g/100 ml. The specific viscosity [$\eta_{sp}$] (25° C.) is determined by a formula (A) below.

$$\eta_{sp}=(\eta/\eta_0) \quad \text{Formula(A):}$$

($\eta_0$: viscosity of toluene, $\eta$: viscosity of solution)

The intrinsic viscosity [$\eta$] is determined by substituting the specific viscosity [$\eta_{sp}$] in a Huggins relational formula shown by formula (B) below.

$$\eta_{sp}=[\eta]+K'[\eta]^2 \quad \text{Formula (B):}$$

(K': Huggins constant K'=0.3 (application of [$\eta$]=1 to 3))

Next, the molecular weight M is determined by substituting the intrinsic viscosity [$\eta$] into an equation of A. Kolorlov shown by formula (C) below.

$$[\eta]=0.215\times10^{-4}M^{0.65} \quad \text{Formula (C):}$$

The siloxane viscosity [$\eta$] is determined by substituting the molecular weight M into an equation of A. J. Barry shown by formula (D) below.

$$\log \eta=1.00+0.0123M^{0.5} \quad \text{Formula (D):}$$

—Amount of Surface Adhesion—

The amount of surface adhesion of the siloxane compound to the surfaces of the specific silica particles is preferably 0.01% by mass or more and 5% by mass or less, more preferably 0.05% by mass or more and 3% by mass or less, and still more preferably 0.10% by mass or more and 2% by mass or less relative to the silica particles (silica particles before surface treatment) from the viewpoint of improving the flowability, dispersibility in the toner particles, aggregation property, and adhesion to the toner particles with respect to the specific silica particles (particularly, from the viewpoint of suppressing solid image unevenness and thin-line image blurring).

The amount of surface adhesion is measured by a method described below.

First, 100 mg of the specific silica particles is dispersed in 1 mL of chloroform, and 1 μL of DMF (N,N-dimethylformamide) is added as an internal standard solution to the resultant dispersion. Then, the siloxane compound is extracted in the chloroform solvent by ultrasonic treatment using an ultrasonic cleaning device for 30 minutes. Then, a spectrum of hydrogen nuclei is measured by JNM-AL400 model nuclear magnetic resonance spectrometer (manufactured by JEOL DATUM Ltd.), the amount of the siloxane compound is determined from a ratio of a peak area due to the siloxane compound to a peak area due to DMF. The amount of surface adhesion is determined from the amount of the siloxane compound.

The specific silica particles are surface-treated with the siloxane compound having a viscosity of 1,000 cSt or more and 50,000 cSt or less, and the amount of surface adhesion of the siloxane compound to the surfaces of the silica particles is preferably 0.01% by mass or more and 5% by mass or less.

By satisfying the requirements, the specific silica particles having good flowability and good dispersibility in the toner particles and the improved aggregation property and adhesion to the toner particles can be easily produced.

—External Addition Amount—

The external addition amount (content) of the specific silica particles is preferably 0.1% by mass or more and 5.0% by mass or less, more preferably 0.2% by mass or more and 3.0% by mass or less, and still more preferably 0.3% by mass or more and 2.0% by mass or less relative to the toner particles from the viewpoint of suppressing solid image unevenness and thin-line image blurring.

[Method for Producing Specific Silica Particles]

The specific silica particles are produced by surface-treating the surfaces of silica particles with the siloxane compound with a viscosity of 1,000 cSt or more and 50,000 cSt or less so that the amount of surface adhesion is 0.01% by mass or more and 5% by mass or less relative to the silica particles.

According to the method for producing the specific silica particles, silica particles having good flowability and good dispersibility in the toner particles and the improved aggregation property and adhesion to the toner particles can be produced.

Examples of the surface treatment method include a method of surface-treating the surfaces of the silica particles with the siloxane compound in supercritical carbon dioxide, and a method of surface-treating the surfaces of the silica particles with the siloxane compound in the air.

Specific examples of the surface treatment method include a method of adhering the siloxane compound to the surfaces of the silica particles by dissolving the siloxane compound in supercritical carbon dioxide; a method of adhering the siloxane compound to the surfaces of the silica particles by applying (for example, spraying or coating) a solution containing the siloxane compound and a solvent which dissolves the siloxane compound to the surfaces of the silica particles; and a method of adding a solution containing the siloxane compound and a solvent which dissolves the siloxane compound to a silica particle dispersion, maintaining the resultant mixture, and then drying the mixture of the silica particle dispersion and the solution.

In particular, the method of adhering the siloxane compound to the surfaces of the silica particles by using supercritical carbon dioxide is preferred.

The surface treatment in supercritical carbon dioxide creates a state in which the siloxane compound is dissolved in the supercritical carbon dioxide. The supercritical carbon dioxide has the property of low surface tension, and thus the siloxane compound dissolved in the supercritical carbon dioxide is considered to easily diffuse, together with the supercritical carbon dioxide, and reach deep parts of pores in the surfaces of the silica particles. Therefore, it is considered that not only the surfaces of the silica particles but also deep parts of the pores are surface-treated with the siloxane compound.

Thus, the silica particles surface-treated with the siloxane compound in supercritical carbon dioxide are considered to be silica particles surface-treated nearly uniformly with the siloxane compound (for example, in a state in which a surface treatment layer is formed in a thin film).

In the method for producing the specific silica particles, surface treatment may be also performed for imparting hydrophobicity to the surfaces of the silica particles by using a hydrophobic treatment agent in combination with the siloxane compound in supercritical carbon dioxide.

This surface treatment creates a state in which the hydrophobic treatment agent, together with the siloxane compound, is dissolved in supercritical carbon dioxide. The siloxane compound and hydrophobic treatment agent dissolved in the supercritical carbon dioxide are considered to easily diffuse, together with the supercritical carbon dioxide, and reach deep parts of pores in the surfaces of the silica particles. Therefore, it is considered that not only the surfaces of the silica particles but also deep parts of the pores are surface-treated with the siloxane compound and the hydrophobic treatment agent.

As a result, the silica particles surface-treated with the siloxane compound and the hydrophobic treatment agent in the supercritical carbon dioxide are easily surface-treated nearly uniformly with the siloxane compound and the hydrophobic treatment agent and imparted with high hydrophobicity.

The method for producing the specific silica particles may use supercritical carbon dioxide in another process for producing silica particles (for example, a solvent removing process or the like).

The method for producing the specific silica particles using supercritical carbon dioxide in the other production process is, for example, a method including preparing a silica particle dispersion containing silica particles and a solvent containing alcohol and water by a sol-gel method (hereinafter, referred to as "dispersion preparation"), removing the solvent from the silica particle dispersion by circulating the supercritical carbon dioxide (hereinafter, referred to as "solvent removal"), and surface-treating the surfaces of the silica particles, from which the solvent has been removed, with the siloxane compound in the supercritical carbon dioxide.

When the solvent is removed from the silica particle dispersion by using the supercritical carbon dioxide, the occurrence of coarse powder can be easily suppressed.

Although the reason for this is unclear, conceivable reasons are as follows: 1) When the solvent is removed from the silica particle dispersion, the solvent can be removed without aggregation of particles due to the liquid bridge force during removal of the solvent because of the property of supercritical carbon dioxide that surface tension does not act. 2) Because of the property of supercritical carbon dioxide that supercritical carbon dioxide is carbon dioxide under conditions of temperature and pressure higher than the critical point and thus has both the diffusion property of gas and the dissolving property of liquid, the supercritical carbon dioxide efficiently comes in contact with the solvent and dissolves the solvent at a relatively low temperature (for example, 250° C. or less), and the supercritical carbon dioxide in which the solvent is dissolved is removed so that the solvent in the silica particle dispersion can be removed without producing coarse powder such as secondary aggregate or the like caused by silanol group condensation.

The solvent removal and the surface treatment may be separately performed but are preferably continuously performed (that is, each of the processes is performed in a state not opened under the atmospheric pressure. When the processes are continuously performed, the silica particles have no opportunity to adsorb water after the solvent removal, and the surface treatment can be performed in a state in which excessive adsorption of water on the silica particles is suppressed. Therefore, a large amount of the siloxane compound need not be used, and the solvent removal and the surface treatment need not be performed at high temperature by excessive heating. Consequently, the occurrence of a coarse powder can be more effectively easily suppressed.

Each of the processes of the method for producing the specific silica particles is described in detail below.

The method for producing the specific silica particles is not limited to the above, and for example, the method may be performed under conditions 1) in which only the surface treatment uses supercritical carbon dioxide or 2) in which the processes are separately performed.

Each of the processes is described in detail below.

—Preparation of Dispersion—

In the preparation of the dispersion, the silica particle dispersion containing, for example, the silica particles and a solvent containing alcohol and water is prepared.

Specifically, in the preparation of the dispersion, the silica particle dispersion is prepared by, for example, a wet method (for example, a sol-gel method or the like). In particular, the sol-gel method is preferred as the wet method, and specifically, the silica particles are produced by reaction (hydrolysis reaction and condensation reaction) of tetraalkoxy silane in the presence of an alkali catalyst in a solvent containing alcohol and water, preparing the silica particle dispersion.

The preferred range of the average circle-equivalent particle diameter of the silica particles and the preferred range of the average circularity are as described above.

For example, when the silica particles are produced by the wet method, a dispersion (silica particle dispersion) in which the silica particles are dispersed in the solvent is produced in the preparation of the dispersion.

In transferring to the solvent removal, the silica particle dispersion prepared has a water-to-alcohol mass ratio of, for example, 0.05 or more and 1.0 or less, preferably 0.07 or more and 0.5 or less, and more preferably 0.1 or more and 0.3 or less.

When the silica particle dispersion has a water-to-alcohol mass ratio within the range described above, a coarse powder of the silica particles little occurs after the surface treatment, and the silica particles having good electrical resistance can be easily produced.

When the water-to-alcohol mass ratio is lower than 0.05, silanol group condensation little occurs on the surfaces of the silica particles during solvent removal in the solvent removal process, the amount of water adsorbed on the surfaces of the silica particles after the solvent removal is increased, and thus the electrical resistance of the silica particles after the surface treatment may be excessively decreased. While when the water-to-alcohol mass ratio exceeds 1.0, a large amount of water remains near the end point of the solvent removal from the silica particle dispersion in the solvent removal process, and thus aggregation of the silica particles may easily occur due to liquid bridge force and may be present as a coarse powder after the surface treatment.

Also, in transferring to the solvent removal, the silica particle dispersion prepared has a water-to-silica particle mass ratio of, for example, 0.02 or more and 3 or less, preferably 0.05 or more and 1 or less, and more preferably 0.1 or more and 0.5 or less.

When the silica particle dispersion has a water-to-silica particle mass ratio within the range described above, a coarse powder of the silica particles little occurs, and the silica particles having good electrical resistance can be easily produced.

When the water-to-silica particle mass ratio is lower than 0.02, silanol group condensation on the surfaces of the silica particles is extremely decreased during solvent removal in the solvent removal process, the amount of water adsorbed on the surfaces of the silica particles after the solvent removal is increased, and thus the electrical resistance of the silica particles may be excessively decreased.

While when the water-to-silica particle mass ratio exceeds 3, a large amount of water remains near the end point of the solvent removal from the silica particle dispersion in the solvent removal process, and thus aggregation of the silica particles may easily occur due to liquid bridge force.

Also, in transferring to the solvent removal, the silica particle dispersion prepared has a silica particle-to-silica particle dispersion mass ratio of, for example, 0.05 or more and 7 or less, preferably 0.2 or more and 0.65 or less, and more preferably 0.3 or more and 0.6 or less.

When the silica particle-to-silica particle dispersion mass ratio is lower than 0.05, the amount of supercritical carbon dioxide used in the solvent removal may be increased, and productivity may be degraded.

While when the silica particle-to-silica particle dispersion mass ratio exceeds 0.7, the distance between the silica particles in the silica particle dispersion is decreased, and thus the occurrence of a coarse powder may easily occur due to aggregation or gelation of the silica particles.

—Solvent Removal—

In the solvent removal, the solvent in the silica particle dispersion is removed by, for example, circulating supercritical carbon dioxide.

That is, in the solvent removal, supercritical carbon dioxide is brought into contact with the silica particle dispersion by circulating the supercritical carbon dioxide, thereby removing the solvent.

Specifically, in the solvent removal, for example, the silica particle dispersion is placed in a closed reactor. Then, liquefied carbon dioxide is added and heated in the closed reactor and then put into a supercritical state by increasing the pressure in the reaction using a high-pressure pump. Then, the supercritical carbon dioxide is circulated in the closed reactor, that is, in the silica particle dispersion, by introducing and discharging the supercritical carbon dioxide into and from the closed reactor.

Thus, the supercritical carbon dioxide in which the solvent (alcohol and water) is dissolved and which is accompanied with the solvent is discharged to the outside of the silica particle dispersion (the outside of the closed reactor), and consequently the solvent is removed.

The supercritical carbon dioxide is carbon dioxide under conditions of temperature and pressure higher than the critical point and has both the diffusion property of gas and the dissolving property of liquid.

The temperature of solvent removal, that is, the temperature of the supercritical carbon dioxide, is, for example, 31°

C. or more and 350° C. or less, preferably 60° C. or more and 300° C. or less, and more preferably 80° C. or more and 250° C. or less.

At the temperature less than the range described above, the solvent is slightly dissolved in the supercritical carbon dioxide, thereby making it difficult to remove the solvent. Also, it is considered that a coarse powder easily occurs due to the liquid bridge force of the solvent and supercritical carbon dioxide. On the other hand, at the temperature exceeding the range described above, it is considered that a coarse powder such as a secondary aggregate or the like easily occurs due to silanol group condensation on the surfaces of the silica particles.

The pressure of solvent removal, that is, the pressure of the supercritical carbon dioxide, is, for example, 7.38 MPa or more and 40 MPa or less, preferably 10 MPa or more and 35 MPa or less, and more preferably 15 MPa or more and 25 MPa or less.

At the pressure less than the range described above, the solvent tends to be slightly dissolved in the supercritical carbon dioxide, while at the pressure exceeding the range described above, the equipment cost tends to be increased.

Also, the amount of supercritical carbon dioxide introduced into and discharged from the closed reactor is, for example, 15.4 L/min/$m^3$ or more and 1540 L/min/$m^3$ or less and preferably 77 L/min/$m^3$ or more and 770 L/min/$m^3$ or less.

When the amount of supercritical carbon dioxide introduced and discharged is less than 15.4 L/min/$m^3$, much time is required for removing the solvent, and thus productivity tends to be easily degraded.

On the other hand, when the amount of the amount of supercritical carbon dioxide introduced and discharged exceeds 1540 L/min/$m^3$, the supercritical carbon dioxide is short-passed, and thus the time of contact with the silica particle dispersion is shortened, thereby causing the tendency to make it difficult to efficiently remove the solvent.

—Surface Treatment—

In the surface treatment, the surfaces of the silica particles are treated with the siloxane compound in supercritical carbon dioxide in succession with the solvent removal.

That is, in the surface treatment, for example, the surfaces of the silica particles are treated with the siloxane compound in supercritical carbon dioxide without exposure to the atmosphere before transfer from the solvent removal.

Specifically, in the surface treatment, for example, after the introduction and discharge of supercritical carbon dioxide into and from the closed reactor for solvent removal is stopped, the temperature and pressure in the closed reactor are adjusted, and the siloxane compound at a predetermined ratio to the silica particles is added to the closed reactor in which the supercritical carbon dioxide is present. Then, under conditions in which this state is maintained, the silica particles are surface-treated by reaction of the siloxane compound in the supercritical carbon dioxide.

In the surface treatment, the siloxane compound may be reacted in the supercritical carbon dioxide (that is, in an atmosphere of supercritical carbon dioxide), and the surface treatment may be performed under circulation of supercritical carbon dioxides (that is, supercritical carbon dioxide is introduced and discharged into and from the closed reactor) or without the circulation.

In the surface treatment, the amount (charge amount) of the silica particles relative to the volume of the reactor is, for example, 30 g/L or more and 600 g/L or less, preferably 50 g/L or more and 500 g/L or less, and more preferably 80 g/L or more and 400 g/L or less.

With the amount less than the range described above, the concentration of the siloxane compound relative to the supercritical carbon dioxide is decreased, and the probability of contact with the silica particle surfaces is decreased, thereby causing the reaction to little proceed. On the other hand, with the amount exceeding the range described above, the concentration of the siloxane compound relative to the supercritical carbon dioxide is increased, and thus the siloxane compound is not completely dissolved in the supercritical carbon dioxide and insufficiently dispersed, thereby easily causing the occurrence of a coarse aggregate.

The density of the supercritical carbon dioxide is, for example, 0.10 g/ml or more and 0.80 g/ml or less, preferably 0.10 g/ml or more and 0.60 g/ml or less, and more preferably 0.2 g/ml or more and 0.50 g/ml or less.

With the density lower than the range described above, the solubility of the siloxane compound in the supercritical carbon dioxide is decreased, and thus an aggregate tends to occur. On the other hand, with the density higher than the range described above, diffusion into silica fine pores is decreased, and thus the surface treatment may become insufficient. In particular, the surface treatment of sol-gel silica particles containing many silanol groups is preferably performed within the density range described above.

The density of the supercritical carbon dioxide is adjusted by temperature, pressure, and the like.

Examples of the siloxane compound are as described above. The preferred range of viscosity of the siloxane compound is also as described above.

When silicone oil is used as the siloxane compound, the silicone oil easily adheres in a nearly uniform state to the surfaces of the silica particles, and the flowability, dispersibility, and handleability of the silica particles are easily improved.

The amount of the siloxane compound used is, for example, 0.05% by mass or more and 3% by mass or less, preferably 0.1% by mass or more and 2% by mass or less, and more preferably 0.15% by mass or more and 1.5% by mass or less based on the silica particles from the viewpoint that the amount of surface adhesion to the silica particles can be easily controlled to 0.01% by mass or more and 5% by mass or less.

The siloxane compound may be used singly or used as a mixture with a solvent in which the siloxane compound is easily dissolved. Examples of the solvent include toluene, methyl ethyl ketone, methyl isobutyl ketone, and the like.

In the surface treatment, the silica particles may be surface-treated with a mixture of the siloxane compound and the hydrophobic treatment agent.

The hydrophobic treatment agent is, for example, a silane-based hydrophobic treatment agent. Examples of the silane-based hydrophobic treatment agent include known silicon compounds having an alkyl group (for example, a methyl group, an ethyl group, a propyl group, a butyl group, or the like). Specific examples thereof include silazane compounds (for example, silane compounds such as methyltrimethoxysilane, dimethyldimethoxysilane, trimethylchlorosilane, trimethylmethoxysilane, and the like, hexamethyldisilazane, tetramethyldisilazane, and the like) and the like. The hydrophobic treatment agents may be used alone or in combination of two or more.

Among the silane-based hydrophobic treatment agents, silicon compounds having a trimethyl group, such as trimethylmethoxysilane, hexamethyldisilazane (HMDS), and the like are preferred, and hexamethyldisilazane (HMDS) is particularly preferred.

The amount of the silane-based hydrophobic treatment agent used is not particularly limited and is, for example, 1% by mass or more and 100% by mass or less, preferably 3% by mass or more and 80% by mass or less, and more preferably 5% by mass or more and 50% by mass or less based on the silica particles.

The silane-based hydrophobic treatment agent may be used singly or used as a mixture with a solvent in which the silane-based hydrophobic treatment agent is easily dissolved. Examples of the solvent include toluene, methyl ethyl ketone, methyl isobutyl ketone, and the like.

The temperature condition of the surface treatment, that is, the temperature of supercritical carbon dioxide, is, for example, 80° C. or more and 300° C. or less, preferably 100° C. or more and 250° C. or less, and more preferably 120° C. or more and 200° C. or less.

At the temperature lower than the range described above, the surface treatment ability of the siloxane compound may be decreased. On the other hand, at the temperature exceeding the range described above, condensation reaction between silanol groups of the silica particles proceeds, and thus particle aggregation may occur. In particular, the surface treatment of sol-gel silica particles having many silanol groups is preferably performed within the temperature range described above.

On the other hand, the pressure condition of the surface treatment, that is, the pressure of supercritical carbon dioxide, may be a condition satisfying the density described above and is, for example, 8 MPa or more and 30 MPa or less, preferably 10 MPa or more and 25 MPa or less, and more preferably 15 MPa or more and 20 MPa or less.

The specific silica particles are produced through the processes described above.

[Other External Additive]

Examples of other external additives include inorganic particles. Examples of the inorganic particles include $SiO_2$ (excluding the specific silica particles), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surfaces of inorganic particles as the other external additive are preferably hydrophobically treated. Hydrophobic treatment is performed by, for example, immersing the inorganic particles in the hydrophobic treatment agent. Examples of the hydrophobic treatment agent include, but are not particularly limited to, silane-based coupling agents, silicone oil, titanate-based coupling agents, aluminum-based coupling agents, and the like. These may be used alone or in combination of two or more.

The amount of the hydrophobic treatment agent is generally, for example, 1 part by mass or more and 10 parts by mass or less based on 100 parts by mass of the inorganic particles.

Other examples of the other external additives include resin particles (resin particles of polystyrene, polymethyl methacrylate (PMMA), melamine resin, and the like), cleaning active agents (for example, higher-fatty acid metal salts such as zinc stearate and fluorine-based polymer particles), and the like.

The amount of the other external additive externally added is, for example, 0% by mass or more and 4.0% by mass or less and preferably 0% by mass or more and 2.0% by mass or less based on the toner particles.

(Method for Producing Toner)

Next, a method for producing the magnetic one-component developer (magnetic toner) according to the exemplary embodiment is described.

The magnetic one-component developer according to the exemplary embodiment can be produced by producing the magnetic toner particles and then externally adding the external additive to the magnetic toner particles.

The magnetic toner particles may be produced by any one of a dry method (for example, a kneading/grinding method or the like) and a wet method (for example, an aggregation/coalescence method, a suspension polymerization method, a solution suspension method, or the like). The method for producing the magnetic toner particles is not particularly limited, and a known method is used.

Specifically, for example, when the magnetic toner particles are produced by the aggregation/coalescence method, the toner particles are produced by preparing a resin particle dispersion in which resin particles as a binder resin are dispersed and a magnetic powder dispersion in which a magnetic powder is dispersed (preparation of a dispersion), forming aggregated particles by mixing the dispersions and aggregating the resin particles and the magnetic powder (if required, other particles) in a mixed dispersion (if required, a dispersion prepared by further mixing another particle dispersion) (formation of aggregated particles), and forming magnetic toner particles by heating the resultant aggregated particle dispersion in which the aggregated particles are dispersed and fusing and coalescing the aggregated particles (fusion/coalescence).

Each of the processes is described in detail below.

Although, in the description below, the method for producing the magnetic toner particles containing the coloring agent and the mold release agent is described, the coloring agent and the mold release agent are used according to demand. Of course, other additives other than the coloring agent and the mold release agent may be used.

—Preparation of Resin Particle Dispersion—

First, a resin particle dispersion in which resin particles as a binder resin are dispersed and a magnetic powder dispersion in which a magnetic powder is dispersed, and, for example, a coloring agent particle dispersion in which coloring agent particles are dispersed and a mold release agent particle dispersion in which mold release agent particles are dispersed are prepared.

The resin particle dispersion is prepared by, for example, dispersing the resin particles in a dispersion medium using a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include anionic surfactants such as sulfuric acid ester salt-based, sulfonic acid ester salt-based, phosphoric acid ester-based, and soap-based surfactants, and the like; cationic surfactants such as amine salt-based and quaternary ammonium salt-based surfactants, and the like; nonionic surfactants such as polyethylene glycol-based, alkylphenol ethylene oxide adduct-based, and polyhydric alcohol-based surfactants, and the like; and the like. Among these, the anionic surfactant and the cationic surfactant are preferred. The nonionic surfactant may be used in combination with the anionic surfactant or the cationic surfactant.

The surfactants may be used alone or in combination of two or more.

The method for dispersing the resin particles in the dispersion medium of the resin particle dispersion is, for example, a general dispersion method using a rotational shear-type homogenizer, a ball mill, sand mill, or dyno-mill using a medium, or the like. Also, the resin particles may be dispersed in the resin particle dispersion by, for example, using a phase-inversion emulsification method according to the type of the resin particles.

The phase-inversion emulsification method is a method including dissolving a resin to be dispersed in a hydrophobic organic solvent which can dissolve the resin, neutralizing an organic continuous phase (O phase) by adding a base, and then inverting the resin (so-called phase inversion) from W/O to O/W by adding an aqueous medium (W phase) to form a discontinuous phase, thereby dispersing particles of the resin in the aqueous medium.

The volume-average particle diameter of the resin particles dispersed in the resin particle dispersion is, for example, preferably 0.01 μm or more and 1 μm or less, more preferably 0.08 μm or more and 0.8 μm or less, and still more preferably 0.1 μm or more and 0.6 μm or less.

With respect to the volume-average particle diameter of the resin particles, a volume-based cumulative distribution is formed from the small-diameter side for divided particle size ranges (channels) by using a particle size distribution obtained by measurement with a laser diffraction particle size distribution analyzer (for example, LA-700 manufactured by Horiba, Ltd.), and the particle diameter at 50% in the cumulative distribution of the all particles is measured as volume-average particle diameter D50v. The volume-average particle diameters of particles in other dispersions are measured by the same method.

The content of the resin particles contained in the resin particle dispersion is, for example, preferably 5% by mass or more and 50% by mass or less and more preferably 10% by mass or more and 40% by mass or less.

For example, the magnetic powder dispersion, the coloring agent particle dispersion, and the mold release agent particle dispersion are prepared by the same method as for the resin particle dispersion. That is, the volume-average particle diameter of the resin particles, the dispersion medium, the dispersion method, and the particle content in the resin particle dispersion are true for the magnetic powder dispersed in the magnetic powder dispersion, the coloring agent particles dispersed in the coloring agent particle dispersion, and the mold release agent particles dispersed in the mold release agent particle dispersion.

—Formation of Aggregated Particles—

Next, the resin particle dispersion is mixed with the magnetic powder dispersion, the coloring agent particle dispersion, and the mold release agent particle dispersion.

Then, the resin particles, the magnetic powder, the coloring agent particles, and the mold release agent particles are hetero-aggregated in the resultant mixed dispersion to form the aggregated particles which have a diameter close to the diameter of the desired magnetic toner and which contain the resin particles, the magnetic powder, the coloring agent particles, and the mold release agent particles.

Specifically, for example, a coagulant is added to the mixed dispersion, and the mixed dispersion is adjusted to acidic pH (for example, pH of 2 or more and 5 or less). If required, a dispersion stabilizer is added to the mixed dispersion. Then, the particles dispersed in the mixed dispersion are aggregated by heating to the glass transition temperature of the resin particles (for example, (resin particle glass transition temperature—30° C.) or more and (resin particle glass transition temperature—10° C.) or less, thereby forming the aggregated particles.

The aggregated particles may be formed by, for example, adding the coagulant to the mixed dispersion at room temperature (for example, 25° C.) under stirring in a rotational shear-type homogenizer, adjusting the mixed dispersion to acidic pH (for example, pH of 2 or more and 5 or less), if required adding the dispersion stabilizer to the mixed dispersion, and then heating the mixed dispersion.

Examples of the coagulant include surfactants with polarity opposite to that of the surfactant used as the dispersant added to the mixed dispersion, inorganic metal salts, and di- or higher-valent metal complexes. In particular, when a metal complex is used as the coagulant, the amount of the surfactant used is decreased, thereby improving charging characteristics.

Also, if required, an additive which forms a complex or similar bond with a metal ion of the coagulant may be used. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartaric acid, citric acid, gluconic acid, and the like; imino-diacid (IDA), nitrilotriacetic acid (NTA), ethylene diamine tetraacetic acid (EDTA), and the like.

The amount of the chelating agent added is, for example, preferably 0.01 parts by mass or more and 5.0 parts by mass or less and more preferably 0.1 parts by mass or more and less than 3.0 parts by mass relative to 100 parts by mass of the resin particles.

—Fusion/Coalescence—

Next, the aggregated particles are fused and coalesced by, for example, heating the aggregated particle dispersion in which the aggregated particles are dispersed to a temperature equal to or higher than the glass transition temperature of the resin particles (for example, equal to or 10° C. to 30° C. higher than the glass transition temperature of the resin particles), thereby forming the magnetic toner particles.

The magnetic toner particles are produced by the method described below.

The magnetic toner particles may be produced by preparing an aggregated particle dispersion in which the aggregated particles are dispersed, further aggregating the particles by mixing the aggregated particle dispersion with the resin particle dispersion in which the resin particles are dispersed to form second aggregated particles, and fusing and coalescing the second aggregated particles by heating a second aggregated particle dispersion in which the second aggregated particles are dispersed to form magnetic toner particles having a core-shell structure.

After the completion of fusion and coalescence, dry toner magnetic particles are produced through washing, solid-liquid separation, and drying of the magnetic toner particles formed in the solution.

The washing is preferably displacement washing with ion exchange water from the viewpoint of chargeability. The solid-liquid separation is not particularly limited but is preferably performed by suction filtration, pressure filtration, or the like from the viewpoint of productivity. The drying method is not particularly limited but is preferably freeze drying, flash drying, fluidized drying, vibration-type fluidized drying, or the like from the viewpoint of productivity.

The magnetic one-component developer (magnetic toner) according to the exemplary embodiment is produced by, for example, adding the external additive to the resultant dry magnetic toner particles and mixing the mixture. Mixing may be performed by, for example, a V-blender, a Henschel mixer, Lodige mixer, or the like. Further, if required, coarse particles of the magnetic toner may be removed by a vibration sieving machine, a wind power sieving machine, or the like.

<Image Forming Apparatus/Image Forming Method>

An image forming apparatus/image forming method according to an exemplary embodiment of the present invention is described.

The image forming apparatus according to the exemplary embodiment includes an image holding member, a charging unit which charges the surface of the image holding member, an electrostatic image forming unit which forms an electrostatic image on the surface of the charged image holding member, a development unit which contains a magnetic one-component developer and develops, as a toner image, the electrostatic image formed on the surface of the image holding member with the magnetic one-component developer, a transfer unit which transfers the toner image formed on the surface of the image holding member to the surface of a recording medium, and a fixing unit which fixes the toner image transferred to the surface of the recording medium. The magnetic one-component developer according to the exemplary embodiment is used as the magnetic one-component developer.

The image forming apparatus according to the exemplary embodiment performs the image forming method (image forming method according to the exemplary embodiment) including charging the surface of the image holding member, forming an electrostatic image on the surface of the charged image holding member, developing as a toner image, the electrostatic image formed on the surface of the image holding member with the magnetic one-component developer according to the exemplary embodiment, transferring the toner image formed on the surface of the image holding member to the surface of a recording medium, and fixing the toner image transferred to the surface of the recording medium.

In the image forming apparatus according to the exemplary embodiment, a magnetic one-component development-system development unit is applied to the development unit. The magnetic one-component development-system development unit includes, for example, a developer holding member disposed to face the image holding member and containing a built-in magnet, a stirring member which supplies the magnetic one-component developer (magnetic toner) contained in a housing to the surface of the developer holding member while stirring the magnetic one-component developer, and a layer regulating member which is disposed in contact or out of contact with the surface of the developer holding member on the downstream side of the position facing the image holding member in the rotational direction of the developer holding member so as to regulate the thickness of the magnetic toner layer (magnetic one-component developer layer) on the surface of the developer holding member and to frictionally charge the magnetic toner. A known device may be used as a nonmagnetic one-component development-system development unit.

Examples of an apparatus used as the image forming apparatus according to the exemplary embodiment include known image forming apparatus, such as an apparatus of a direct-transfer system in which the toner image formed on the surface of the image holding member is directly transferred to the recording medium, an apparatus of an intermediate-transfer system in which the toner image formed on the surface of the image holding member is first transferred to the surface of an intermediate transfer body, and the toner image transferred to the surface of the intermediate transfer body is second transferred to the surface of the recording medium; an apparatus including a cleaning unit which cleans the surface of the image holding member before charging after transfer of the toner image; an apparatus including an elimination unit which eliminates charge by irradiating the surface of the image holding member with eliminating light before charging after transfer of the toner image, and the like.

In the case of an apparatus of an intermediate-transfer system, a configuration applied to the transfer unit includes, for example, an intermediate transfer body to which the toner image is transferred to the surface, a first transfer unit which transfers the toner image formed on the surface of the image holding member to the surface of the intermediate transfer body, and a second transfer unit which transfers the toner image transferred to the surface of the intermediate transfer body to the surface of the recording medium.

In the image forming apparatus according to the exemplary embodiment, for example, a part including the development unit may be a cartridge structure (process cartridge) which is detachably mounted on the image forming apparatus. The process cartridge used is preferably, for example, a process cartridge including a development unit containing the magnetic one-component developer according to the exemplary embodiment.

An example of the image forming apparatus according to the exemplary embodiment is described below, but the image forming apparatus is not limited to this. Further, principal parts shown in the drawings are described, but description of other parts is omitted.

FIG. 1 is a schematic configuration diagram showing an example of the image forming apparatus according to the exemplary embodiment.

An image forming apparatus 100 shown in FIG. 1 includes a photoreceptor 107 (an example of the image holding member). Also, around the photoreceptor 107, there are disposed a charging roller 108 (an example of the charging unit) which charges the photoreceptor 107, an exposure device 109 (an example of the electrostatic image forming unit) which forms an electrostatic image by exposure of the photoreceptor 107 charged by the charging device 108, a development device 111 (an example of the development unit) which forms a toner image by developing the electrostatic image formed by the exposure device 110 with the magnetic one-component developer (magnetic toner), a transfer device 112 (an example of the transfer unit) which transfers the toner image formed by the development device 111 to recording paper 300 (an example of the recording medium), and a cleaning device 113 (an example of the cleaning unit) which removes the toner remaining on the photoreceptor 107 after transfer. Also, a fixing device 115 (an example of the fixing unit) which fixes the toner image to the recording paper 300 is disposed.

A device used in usual image forming apparatuses is applied to any one of the devices in the image forming apparatus 100.

Figure 2:
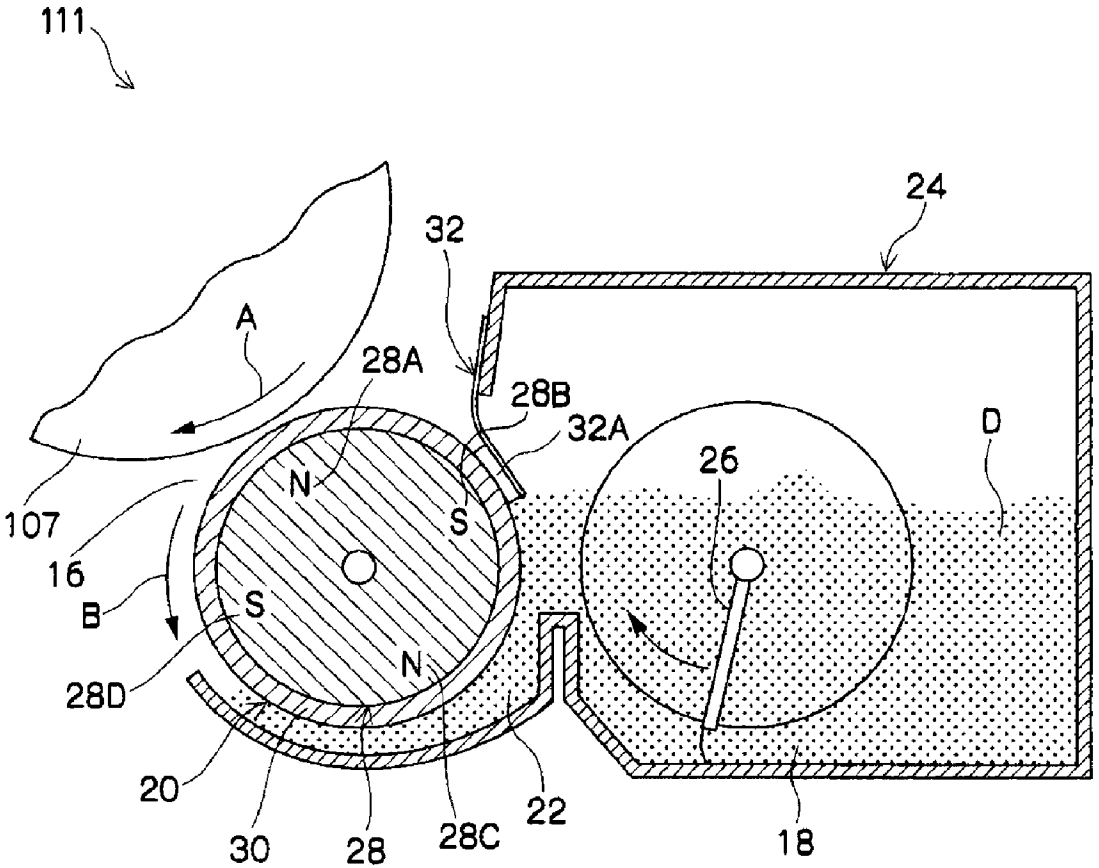
FIG. 2 is a schematic configuration diagram showing an example of a development device in an image forming apparatus according to an exemplary embodiment of the present invention.

As shown in FIG. 2, the development device 111 includes a housing 24 including a developer housing chamber 18 which houses a magnetic one-component developer D, and a development roller housing chamber 22 which houses the development roller (an example of the developer holding member) 20. The housing 24 has an opening formed to communicate the developer housing chamber 18 and the developer roller housing chamber 22 so that the magnetic one-component developer D stirred with a stirring member 26 (for example, an agitator) is supplied from the developer housing chamber 18 to the development roller housing chamber 22 through the opening.

Further, an opening 16 is provided in the upper portion of the development housing chamber 22 so as to expose a portion of the development roller 20 to the outside. The opening 16 allows the development roller 20 to face the photoreceptor 107. A region where the development roller 20 faces the photoreceptor 107 corresponds to a development region to which the magnetic one-component developer D is transported by the development roller 20. Also, a power supply (not shown) which applies a development bias to the development roller 20 is connected.

The development roller 20 includes a built-in magnet roller 28 (an example of the magnet). Specifically, the development roller 20 includes a magnet roller 28 fixed so as not to rotate and including plural magnetic poles 28A to 28D (in FIG. 2, 4 poles) which are alternately disposed, and a non-magnetic cylindrical development sleeve 30 provided on the periphery of the magnet roller 28 and rotating in a direction (direction B in FIG. 2).

On the other hand, a layer thickness regulating blade (an example of the layer regulating member) in contact with the surface of the development sleeve 30 is attached to the housing 24 in order to regulate the thickness of the layer (magnetic toner layer) of the magnetic one-component developer D formed on the development sleeve 30 and to frictionally charge the magnetic toner. The layer regulating blade 32 has a rubber member 32A provided in a portion in contact with the surface of the development sleeve 30.

In the development device 111, the magnetic one-component developer D is stirred and transported by rotation of the stirring member 26 in the developer housing chamber 18 and supplied from the developer housing chamber 18 to the development roller chamber 22 through the opening. The magnetic one-component developer D adheres to the surface of the development sleeve 30 of the development roller 20 by magnetic force of the magnet roller 28, and then the layer thickness is regulated by a projection amount and contact pressure of the layer regulating blade 32 and, at the same time, the developer D is frictionally charged. The magnetic one-component developer D (magnetic toner) frictionally charged is transported to the development region by rotation of the development roller 30, and the electrostatic image on the photoreceptor 107 is developed.

<Process Cartridge/Developer Cartridge>

A process cartridge according to an exemplary embodiment of the present invention is described.

The process cartridge according to the exemplary embodiment is a process cartridge detachably mounted on the image forming apparatus and including a development unit which contains the magnetic one-component developer (magnetic toner) according to the exemplary embodiment and develops as the toner imager the electrostatic image formed on the image holding member.

The process cartridge according to the exemplary embodiment is not limited to the configuration described above, and may have a configuration including a development device and, if required, for example, at least one selected from other units such as an image holding member, a charging unit, an electrostatic image forming unit, and a transfer unit, etc.

An example of the process cartridge according to the exemplary embodiment is described below, but the process cartridge is not limited to this. Further, principal parts shown in the drawings are described, but description of other parts is omitted.

Figure 3:
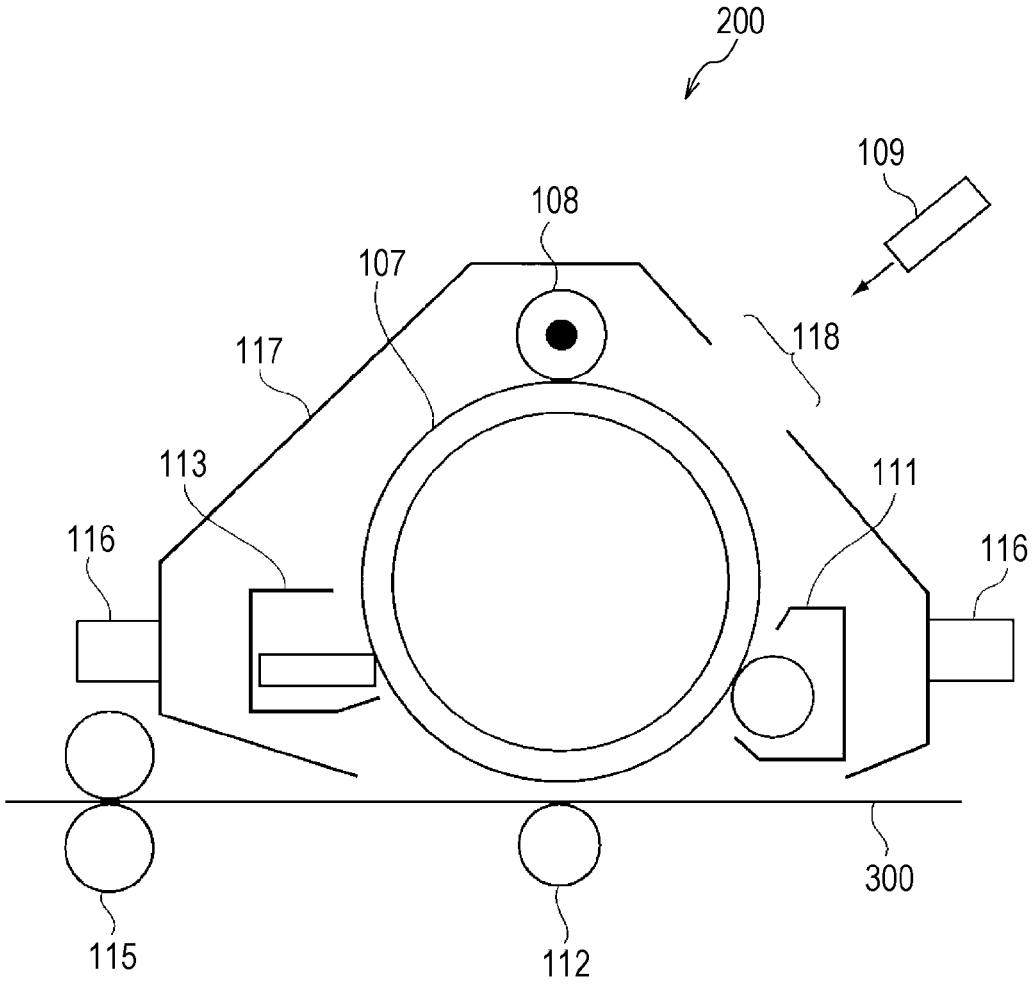
FIG. 3 is a schematic configuration diagram showing an example of a process cartridge according to an exemplary embodiment of the present invention.

FIG. 3 is a schematic configuration diagram showing the process cartridge according to the exemplary embodiment.

A process cartridge 200 shown in FIG. 3 is a cartridge with a configuration in which a photoreceptor 107 (an example of the image holding member) and a charging roller 108 (an example of the charging unit), a development device 111 (an example of the development unit), and a cleaning device 113 (an example of the cleaning unit), which are provided around the photoreceptor 107, are integrally held in combination by a mounting rail 116 and a housing 117 provided with an opening 118 for exposure.

In FIG. 3, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes recording paper (an example of the recording medium).

Next, a developer cartridge according to an exemplary embodiment of the present invention is described.

The developer cartridge according to the exemplary embodiment is a development cartridge containing the magnetic one-component developer according to the exemplary embodiment and detachable from the image forming apparatus. The developer cartridge is intended to contain the magnetic one-component developer for replenishment to supply the developer to the development unit provided in the image forming apparatus.

The developer cartridge has a structure detachable from the image forming apparatus and is connected to the development device of a corresponding color through a supply tube. When the amount of the magnetic one-component developer contained in the developer cartridge is decreased, the developer cartridge is exchanged.

EXAMPLES

Exemplary embodiments are described in further detail below by giving examples, but the exemplary embodiments are not limited to these examples. In the description below, "parts" and "%" represent "parts by mass" and "% by mass", respectively, unless particularly specified.

[Production of Toner Particles]

(Production of Toner Particles (1))

| | |
|---|---|
| Styrene-butyl acrylate copolymer (copolymerization ratio (mass ratio) = 80:20, weight-average molecular weight Mw = 130,000, glass transition temperature (Tg) = 59° C.) | 44.2 parts |
| Magnetic powder (hexahedral magnetite, average particle diameter: 0.2 μm) | 50 parts |
| Negative charge control agent (salicylic acid-based Cr dye) | 0.8 parts |
| Low-molecular-weight polypropylene (softening point: 148° C.) | 5 parts |

These materials are mixed in a powder state by a Henschel mixer and the resultant mixture is heat-kneaded with an extruder. After cooling, the mixture is roughly ground and finely ground and further classified to produce toner particles (1) having a volume-average particle diameter of 7.2 μm.

(Production of Toner Particles (2))

Resin Particle Dispersion

| | |
|---|---|
| Styrene (manufactured by Wako Pure Chemical Industries, Ltd.) | 330 parts |

-continued

| | |
|---|---|
| n-Butyl acrylate (manufactured by Wako Pure Chemical Industries, Ltd.) | 70 parts |
| β-Carboxyethyl acrylate (manufactured by Rhodia Nicca, Ltd.) | 9 parts |
| 1,10-Decanediol diacrylate (manufactured by Shin-Nakamura Chemical Co., Ltd.) | 1.5 parts |
| Dodecanethiol (manufactured by Wako Pure Chemical Industries, Ltd.) | 2.8 parts |

These components are mixed and dissolved to prepare a raw material solution, and the raw material solution is added to a solution prepared by dissolving 4.5 parts by mass of an anionic surfactant (Dowfax manufactured by Dow Chemical Co.) in 550 parts by mass of ion exchange water. The resultant mixture is dispersed and emulsified in a flask, and 50 parts by mass of ion exchange water in which 6 parts by mass of ammonium pernitrate is dissolved is added to the resultant emulsion under slow stirring and mixing for 10 minutes. Then, the inside of the system is sufficiently replaced with nitrogen, and then the flask is heated in an oil bath until the inside of the system is 70° C. while the flask is stirred. In this state, emulsification polymerization is continued for 6 hours to prepare an anionic resin particle dispersion. The resultant resin particles have a center particle diameter of 185 nm, a solid content of 40%, a glass transition temperature of 53° C., and a weight-average molecular weight Mw of 37,000.

—Magnetic Powder Dispersion—

| | |
|---|---|
| Magnetite (manufactured by Toda Kogyo Corporation, volume-average particle diameter: 0.20 μm) | 20 parts |
| Ionic surfactant (Neogen RK, manufactured by Daiichi Kogyo Seiyaku Co., Ltd.) | 5 parts |
| Ion exchange water | 76 parts |

These components are mixed and preliminarily dispersed by a homogenizer (Ultra-Turrax, manufactured by IKA Corporation) for 10 minutes and then dispersed by using a counter collision-type wet grinding mill (Ultimaizer, manufactured by Sugino Machine Ltd.) under a pressure of 245 Mpa for 20 minutes to prepare a magnetic powder dispersion having a solid content of 20%.

—Mold Release Agent Particle Dispersion—

| | |
|---|---|
| Polyethylene-based wax (Poly Wax 850, manufactured by Toyo Petrolite Co., Ltd, melting point: 107° C.) | 20 parts |
| Ionic surfactant (Neogen RK, manufactured by Daiichi Kogyo Seiyaku C., Ltd.) | 1.2 parts |
| Ion exchange water | 79 parts |

These components are heated to 130° C. and then dispersed by using a Gorlin homogenizer (manufactured by Gorlin Co., Ltd.) under a pressure of 560 kg/cm$^2$ for 30 minutes. Then, the resultant dispersion is cooled to 40° C. to prepare a mold release agent particle dispersion. The resultant mold release agent particle dispersion contains mold release agent particles having a volume-average particle diameter of 170 nm and has a solid content 20%.

—Production of Magnetic Toner Particles—

| | |
|---|---|
| Resin particle dispersion | 100 parts |
| Magnetic powder dispersion | 200 parts |
| Mold release agent particle dispersion | 20 parts |

These components are sufficiently mixed and dispersed by a homogenizer (Ultra-Turrax T50, manufactured by IKA Corporation) in a round stainless flask. Then, 0.5 parts of aluminum polychloride is added to the resultant dispersion, and dispersion is continued with Ultra-Turrax. Then, the resultant mixture is heated to 52° C. under stirring in the flask in a heating oil bath and maintained for 30 minutes. Further, a mixture prepared by mixing, with a homogenizer, 20 parts of the resin particle dispersion and 20 parts of the magnetic powder dispersion is slowly added, and the resultant mixture is maintained for 20 minutes. Further, 20 parts of the resin particle dispersion is added, and the mixture is maintained for 40 minutes.

Then, the system is adjusted to pH 5.3 with a 0.5N aqueous sodium hydroxide solution, and then the stainless flask is closed. Then, the mixture is heated to 96° C. while stirring is continued with a magnetic force seal and then maintained for 5 hours. After the completion of reaction, the reaction product is cooled and filtered, and sufficiently washed with ion exchange water, followed by solid-liquid separation by Nutsche-type suction filtration. Further, the separated solid is again dispersed in 3 L of ion exchange water of 40° C., and stirred and washed at 300 rpm for 30 minutes. This is repeated 5 times, and solid-liquid separation is performed by Nutsche-type suction filtration using No. 5 filter paper. Then, vacuum drying is continued for 12 hours to produce toner particles (2) [black magnetic toner particles].

The resultant toner particles (2) [black magnetic toner particles] have a volume-average particle diameter D50v of 6.5 μm, and the shape factor SF1 of particles determined by shape observation with Image Analyzer LUZEX III is 131. The concentration of magnetic powder in the toner particles (2) is 42%. As a result of measurement by a VSM magnetization characteristic measuring device, the saturation magnetization of the toner particles (2) is 35 Am$^2$/kg.

[Production of External Additive]

(Preparation of Silica Particle Dispersion (1))

In a 1.5 L glass-made reactor provided with a stirrer, a dropping nozzle, and a thermometer, 300 parts of methanol and 70 parts of 10% ammonia water are added and mixed to prepare an alkali catalyst solution.

The alkali catalyst solution is adjusted to 30° C., and 185 parts of tetramethoxysilane and 50 parts of 8.0% ammonia water are simultaneously added dropwisely under stirring to prepare a hydrophilic silica particle dispersion (solid content: 12.0% by mass). The dropping time is 30 minutes.

Then, the resultant silica particle dispersion is concentrated by a rotary filter R-fine (manufactured by Cotobuki Kogyo Co., Ltd.) to a solid concentration of 40% by mass. The concentrated dispersion is used as a silica particle dispersion (1).

(Preparation of Silica Particle Dispersions (2) to (4))

Silica particle dispersions (2) to (4) are prepared by the same method as for the silica particle dispersion (1) except that in preparing the silica particle dispersion (1), the alkali catalyst solution (an amount of methanol and an amount of 10% ammonia water) and silica particle production conditions (the total amount of tetramethoxysilane (denoted as TMOS) and 8% ammonia water dropped and the dropping time) are changed according to Table 1.

The details of the silica particle dispersions (1) to (4) are summarized in Table 1.

TABLE 1

| | Alkali catalyst solution | | Silica particle production condition | | |
|---|---|---|---|---|---|
| | | | TMOS | 8% Ammonia | |
| Silica particle dispersion | Methanol (parts) | 10% Ammonia water (parts) | total dropping amount (parts) | water dropping amount (parts) | Dropping time |
| (1) | 300 | 70 | 185 | 50 | 30 min |
| (2) | 300 | 70 | 340 | 92 | 55 min |
| (3) | 300 | 46 | 40 | 25 | 30 min |
| (4) | 300 | 70 | 62 | 17 | 10 min |

(Production of Surface-Treated Silica Particles (S1))

Silica particles are surface-treated with a siloxane compound in an atmosphere of supercritical carbon dioxide using the silica particle dispersion (1) as follows. Surface treatment is performed by using an apparatus provided with a carbon dioxide cylinder, a carbon dioxide pump, an entrainer pump, an autoclave with a stirrer (volume 500 ml), and a pressure valve.

First, in the autoclave (volume: 500 ml) with a stirrer, 250 parts of the silica particle dispersion (1) is added and the stirrer is rotated at 100 rpm. Then, liquefied carbon dioxide is injected into the autoclave, and the pressure in the autoclave is increased by the carbon dioxide pump under heating with a heater, thereby creating a supercritical state of 150° C. and 15 MPa in the autoclave. Then, supercritical carbon dioxide is circulated by the carbon dioxide pump while the pressure in the autoclave is kept at 15 MPa by the pressure valve to remove methanol and water from the silica particle dispersion (1) (solvent removal), thereby producing silica particles (untreated silica particles).

Next, when the amount (accumulated amount: measured as an amount of carbon dioxide circulated in a standard state) of the supercritical carbon dioxide circulated is 900 parts, the circulation of supercritical carbon dioxide is stopped.

Then, the supercritical state of carbon dioxide is maintained in the autoclave while the pressure is kept at 15 MPa by the carbon dioxide pump the temperature is kept at 150° C. by the heater. In this state, a treatment agent solution previously prepared by dissolving 0.3 parts of dimethyl silicone oil (DSO: trade name "KF-96 (manufactured by Shin-Etsu Chemical Co., Ltd.)") having a viscosity of 10,000 cSt and used as a siloxane compound in 20 parts by hexamethyldisilazane (HMDS: manufactured by Yuki Gosei Kogyo Co., Ltd.) as a hydrophobic treatment agent is introduced into 100 parts of the silica particles (untreated silica particles) in the autoclave using the entrainer pump, followed by reaction at 180° C. for 20 minutes under stirring. Then, supercritical carbon dioxide is again circulated to remove an excess of the treatment agent solution. Then, stirring is stopped, the pressure in the autoclave is released to the atmospheric pressure by opening the pressure valve, and the temperature is decreased to room temperature (25° C.)

As described above, solvent removal and surface treatment with the siloxane compound are sequentially performed to produce surface-treated silica particles (S1).

(Production of Surface-Treated Silica Particles (S2) to (S5), (S7) to (S9), and (S12) to (S14))

Surface-treated silica particles (S2) to (S5), (S7) to (S9), and (S12) to (S14) are produced by the same method as for the surface-treated silica particles (S1) except that in producing the surface-treated silica particles (S1), the silica particle dispersion, surface treatment conditions (treatment atmosphere, siloxane compound (type, viscosity, and adding amount), and the hydrophobic treatment agent and adding amount thereof) are changed according to Table 2.

(Production of Surface-Treated Silica Particles (S6))

Silica particles are surface-treated with a siloxane compound in the air atmosphere by using the same dispersion as the silica particle dispersion (1) used for producing the surface-treated silica particles (S1) as follows.

An ester adaptor and a condenser are attached to the reactor used for producing the silica particle dispersion (1), and methanol is distilled off by heating the silica particle dispersion (1) to 60° C. to 70° C. Then, water is added, and methanol is further distilled off by heating to 70° C. to 90° C. to produce an aqueous dispersion of silica particles. Then, 3 parts of methyl trimethoxysilane (MTMS: manufactured by Shin-Etsu Chemical Co., Ltd.) to 100 parts of silica particles in the aqueous dispersion at room temperature and reacted for 2 hours, thereby treating the surfaces of the silica particles. Then, methyl isobutyl ketone is added to the surface treatment dispersion, and methanol and water are distilled off by heating to 80° C. to 110° C. Then, 80 parts of hexamethyldisilazane (HMDS: manufactured by Yuki Gosei Kogyo Co., Ltd.) and 1.0 part of dimethyl silicone oil (DSO: trade name "KF-96 (manufactured by Shin-Etsu Chemical Co., Ltd.)") having a viscosity or 10,000 cSt and used as a siloxane compound are added to 100 parts of the silica particles in the resultant dispersion, followed by reaction at 120° C. for 3 hours. After cooling, the silica particles are dried by spray drying to produce surface-treated silica particles (S6).

(Production of Surface-Treated Silica Particles (S10))

Surface-treated silica particles (S10) are produced by the same method as for the surface-treated silica particles (1) except that fumed silica OX50 (manufactured by Nippon Aerosil Co., Ltd.) is used in place of the silica particle dispersion (1). That is, 100 parts of OX50 is added to the same autoclave with a stirrer as for producing the surface-treated silica particles (S1), and the stirrer is rotated at 100 rpm. Then, liquefied carbon dioxide is introduced into the autoclave, and the pressure in the autoclave is increased by the carbon dioxide pump while heating with the heater, to create a supercritical state of 180° C. and 15 MPa in the autoclave. Then, in a state in which the pressure in the autoclave is kept at 15 MPa by the pressure valve, a treatment agent solution previously prepared by dissolving 0.3 parts of dimethyl silicone oil (DSO: trade name "KF-96 (manufactured by Shin-Etsu Chemical Co., Ltd.)") having a viscosity of 10,000 cSt and used as a siloxane compound in 20 parts of hexamethyldisilazane (HMDS: manufactured by Yuki Gosei Kogyo Co., Ltd.) as a hydrophobic treatment agent is introduced into the autoclave using the entrainer pump, followed by reaction at 180° C. for 20 minutes under stirring. Then, supercritical carbon dioxide is circulated to remove an excess of the treatment agent solution, thereby producing surface-treated silica particles (S10).

(Production of Surface-Treated Silica Particles (S11))

Surface-treated silica particles (S11) are produced by the same method as for the surface-treated silica particles (1) except that fumed silica A50 (manufactured by Nippon Aerosil Co., Ltd.) is used in place of the silica particle dispersion (1). That is, 100 parts of A50 is added to the same autoclave with a stirrer as for producing the surface-treated silica particles (S1), and the stirrer is rotated at 100 rpm. Then, liquefied carbon dioxide is introduced into the autoclave, and the pressure in the autoclave is increased by the carbon dioxide pump while heating with the heater, to create a supercritical state of 180° C. and 15 MPa in the autoclave. Then, in a state in which the pressure in the autoclave is kept at 15 MPa by the pressure valve, a treatment agent solution previously prepared by dissolving 1.0 part of dimethyl silicone oil (DSO: trade name "KF-96" (manufactured by Shin-Etsu Chemical Co., Ltd.)) having a viscosity of 10,000 cSt and used as a siloxane compound in 40 parts of hexamethyldisilazane (HMDS: manufactured by Yuki Gosei Kogyo Co., Ltd.) as a hydrophobic treatment agent is introduced into the autoclave using the entrainer pump, followed by reaction at 180° C. for 20 minutes under stirring. Then, supercritical carbon dioxide is circulated to remove an excess of the treatment agent solution, thereby producing surface-treated silica particles (S11).

(Production of Surface-Treated Silica Particles (SC1))

Surface-treated silica particles (SC1) are produced by the same method as for the surface-treated silica particles (S1) except that in producing the surface-treated silica particles (S1), the siloxane compound is not added.

(Production of Surface-Treated Silica Particles (CS2) to (CS4))

Surface-treated silica particles (CS2) to (CS4) are produced by the same method as for the surface-treated silica particles (S1) except that in producing the surface-treated silica particles (S1), the silica particle dispersion, surface treatment conditions (treatment atmosphere, siloxane compound (type, viscosity, and adding amount), and the hydrophobic treatment agent and adding amount thereof) are changed according to Table 3.

(Production of Surface-Treated Silica Particles (SC5))

Surface-treated silica particles (SC5) are produced by the same method as for the surface-treated silica particles (S6) except that in producing the surface-treated silica particles (S6), the siloxane compound is not added.

(Production of Surface-Treated Silica Particles (SC6))

Surface-treated silica particles (SC6) are produced by the same method as for the surface-treated silica particles (S11) except that in producing the surface-treated silica particles (S11), the siloxane compound is not added.

(Physical Properties of Surface-Treated Silica Particles)

The obtained surface-treated silica particles are measured by methods described below with respect to the average equivalent circle diameter, average circularity, amount of siloxane compound adhering to the untreated silica particles (in the table, "Surface adhesion amount"), compression and aggregation degree, particle compression ratio, and particle dispersion degree.

Hereinafter, a list of details of the surface-treated silica particles is shown in Table 2 and Table 3. In Table 2 and Table 3, abbreviations are as follows.

DSO: Dimethyl silicone oil

HMDS: Hexamethyldisilazane

TABLE 2

| | | Surface treatment condition | | | | | Characteristic of surface-treated silica particle | | | | | |
|---|---|---|---|---|---|---|---|---|---|---|---|---|
| | | Siloxane compound | | | | | | | | | | |
| Surface-treated silica particle | Silica particle dispersion | Type | Viscosity (cSt) | Adding amount (parts) | Treatment atmosphere | Hydrophobic treatment agent/parts | Average equivalent circle diameter (nm) | Average circularity | Surface adhesion amount (% by mass) | Compression and aggregation degree (%) | Particle compression ratio | Particle dispersion degree (%) |
| (S1) | (1) | DSO | 10000 | 0.3 parts | Supercritical $CO_2$ | HMDS/20 parts | 120 | 0.958 | 0.28 | 85 | 0.310 | 98 |
| (S2) | (1) | DSO | 10000 | 1.0 parts | Supercritical $CO_2$ | HMDS/20 parts | 120 | 0.958 | 0.98 | 92 | 0.280 | 97 |
| (S3) | (1) | DSO | 5000 | 0.15 parts | Supercritical $CO_2$ | HMDS/20 parts | 120 | 0.958 | 0.12 | 80 | 0.320 | 99 |
| (S4) | (1) | DSO | 5000 | 0.5 parts | Supercritical $CO_2$ | HMDS/20 parts | 120 | 0.958 | 0.47 | 88 | 0.295 | 98 |
| (S5) | (2) | DSO | 10000 | 0.2 parts | Supercritical $CO_2$ | HMDS/20 parts | 140 | 0.962 | 0.19 | 81 | 0.360 | 99 |
| (S6) | (1) | DSO | 10000 | 1.0 parts | Atmospheric | HMDS/80 parts | 120 | 0.958 | 0.50 | 83 | 0.380 | 93 |
| (S7) | (3) | DSO | 10000 | 0.3 parts | Supercritical $CO_2$ | HMDS/20 parts | 130 | 0.850 | 0.29 | 68 | 0.350 | 92 |
| (S8) | (4) | DSO | 10000 | 0.3 parts | Supercritical $CO_2$ | HMDS/20 parts | 90 | 0.935 | 0.29 | 94 | 0.390 | 95 |
| (S9) | (1) | DSO | 50000 | 1.5 parts | Supercritical $CO_2$ | HMDS/20 parts | 120 | 0.958 | 1.25 | 95 | 0.240 | 91 |
| (S10) | Fumed silica OX50 | DSO | 10000 | 0.3 parts | Supercritical $CO_2$ | HMDS/20 parts | 80 | 0.680 | 0.26 | 84 | 0.395 | 92 |
| (S11) | Fumed silica A50 | DSO | 10000 | 1.0 parts | Supercritical $CO_2$ | HMDS/40 parts | 45 | 0.880 | 0.91 | 88 | 0.276 | 91 |
| (S12) | (3) | DSO | 5000 | 0.04 parts | Supercritical $CO_2$ | HMDS/20 parts | 130 | 0.850 | 0.02 | 62 | 0.360 | 96 |
| (S13) | (3) | DSO | 1000 | 0.5 parts | Supercritical $CO_2$ | HMDS/20 parts | 130 | 0.850 | 0.46 | 90 | 0.380 | 92 |
| (S14) | (3) | DSO | 10000 | 5.0 parts | Supercritical $CO_2$ | HMDS/20 parts | 130 | 0.850 | 4.70 | 95 | 0.360 | 91 |

TABLE 3

| Surface treated silica particle | Silica particle dispersion | Surface treatment condition: Siloxane compound: Type | Viscosity (cSt) | Adding amount (parts) | Treatment atmosphere | Hydrophobic treatment agent/parts | Characteristic of surface-treated silica particle: Average equivalent circle diameter (nm) | Average circularity | Surface adhesion amount (% by mass) | Compression and aggregation degree (%) | Particle compression ratio | Particle dispersion degree (%) |
|---|---|---|---|---|---|---|---|---|---|---|---|---|
| (SC1) | (1) | — | — | — | Supercritical $CO_2$ | HMDS/20 parts | 120 | 0.958 | — | 55 | 0.415 | 99 |
| (SC2) | (1) | DSO | 100 | 3.0 parts | Supercritical $CO_2$ | HMDS/20 parts | 120 | 0.958 | 2.5 | 98 | 0.450 | 75 |
| (SC3) | (1) | DSO | 1000 | 8.0 parts | Supercritical $CO_2$ | HMDS/20 parts | 120 | 0.958 | 7.0 | 99 | 0.360 | 83 |
| (SC4) | (3) | DSO | 3000 | 10.0 parts | Supercritical $CO_2$ | HMDS/20 parts | 130 | 0.850 | 8.5 | 99 | 0.380 | 85 |
| (SC5) | (1) | — | — | — | Atmospheric | HMDS/80 parts | 120 | 0.958 | — | 62 | 0.425 | 98 |
| (SC6) | Fumed silica A50 | — | — | — | Supercritical $CO_2$ | HMDS/40 parts | 45 | 0.880 | — | 51 | 0.290 | 95 |

Examples 1 to 20 and Comparative Examples 1 to 5

A magnetic one-component developer (magnetic toner) of each of the examples is produced by adding 0.7 parts of colloidal silica (average equivalent circle diameter: 12 nm, treated with hexamethyldisilazane (HMDS)) and a number of parts (shown in Table 4) of the silica particles shown in Table 4 to 100 parts of toner particles shown in Table 4 and Table 5 and mixing the resultant mixture by using a Henschel mixer at 2000 rpm for 3 minutes.

Example 21

A magnetic one-component developer (magnetic toner) is produced by adding 1,2 parts of the silica particles (S11) to 100 parts of the toner particles (2) and mixing the resultant mixture by using a Henschel mixer at 2000 rpm for 3 minutes.

Comparative Example 6

A magnetic one-component developer (magnetic toner) is produced by adding 1,2 parts of the silica particles (SC6) to 100 parts of the toner particles (2) and mixing the resultant mixture by using a Henschel mixer at 2000 rpm for 3 minutes.

[Evaluation]

The magnetic one-component developer (magnetic toner) produced in each of the examples is evaluated as follows. The results are shown in Table 4 and Table 5.

A development device of an image forming apparatus "a modified apparatus of Docu Print 400 manufactured by Fuji Xerox Co., Ltd." is filled with the magnetic one-component developer (magnetic toner) produced in each of the examples. An A4 full-page solid image is output with an image density of 100% on 5000 sheets of A4 paper by using the image forming apparatus in an environment of 30° C. and 90% RH, and then a one-dot line image (10 lines/A4) is output on a sheet of A4 paper. Then, a thin-line image output on the first sheet is visually observed to evaluate thin-line reproducibility based on evaluation criteria below. Further, an image density is measured by Xrite at 5 points randomly selected in the solid image on the 5000th sheet, and the average density and a difference (Δ density) between maximum density and minimum density are calculated. Also, the presence of while stripes on the image and blurring in a non-image portion are visually observed.

Image output is further performed on 5,000 sheets (total of 10,000 sheets), and the same evaluation is performed.

The evaluation criteria are as described below. However, any lower one of evaluation results is adopted, and when evaluation "D" is obtained at the 50000th sheet, evaluation is stopped.

—Thin-Line Reproducibility—

A: No problem is visually observed in all of 10 thin lines.

B: Blurring is visually observed in 1 or more and 2 or less of thin lines, without line cutting.

C: Blurring is visually observed in 3 or more of thin lines, without line cutting.

D: Some of the lines are cut.

—Printed Image Evaluation (Solid Image Unevenness)—

A: Average density of 1.5 or more and Δ density of less than 0.1, without white stripe B: Average density of 1.4 or more and Δ density of 0.1 or more and less than 0.2, without white stripe C: Average density of 1.4 or more and Δ density of 0.2 or more and less than 0.3, without white stripe D: Other evaluation results

TABLE 4

| | Developer: Toner particle | Surface-treated silica particle: Type | Parts | Evaluation at 5000th sheet (first): Printed image evaluation | Thin-line reproducibility | Evaluation at 10000th sheet (second): Printed image evaluation | Thin-line reproducibility | Remarks |
|---|---|---|---|---|---|---|---|---|
| Example 1 | (2) | (S1) | 0.5 | A | A | A | A | |
| Example 2 | (2) | (S2) | 0.5 | A | A | A | A | |
| Example 3 | (2) | (S3) | 0.5 | A | A | A | A | |

TABLE 4-continued

| | Developer | | | Evaluation at 5000th sheet (first) | | Evaluation at 10000th sheet (second) | | |
|---|---|---|---|---|---|---|---|---|
| | Toner particle | Surface-treated silica particle Type | Surface-treated silica particle Parts | Printed image evaluation | Thin-line reproducibility | Printed image evaluation | Thin-line reproducibility | Remarks |
| Example 4 | (2) | (S4) | 0.5 | A | A | A | A | |
| Example 5 | (2) | (S5) | 0.6 | A | A | A | A | |
| Example 6 | (2) | (S6) | 0.5 | A | B | B | C | |
| Example 7 | (2) | (S7) | 0.5 | A | A | B | B | |
| Example 8 | (2) | (S8) | 0.4 | A | B | C | C | |
| Example 9 | (2) | (S9) | 0.5 | A | A | A | B | |
| Example 10 | (2) | (S10) | 0.3 | A | B | C | B | |
| Example 11 | (2) | (S11) | 0.2 | A | B | C | B | |
| Example 12 | (2) | (S12) | 0.5 | A | A | B | B | |
| Example 13 | (2) | (S13) | 0.5 | A | B | C | C | |
| Example 14 | (2) | (S14) | 0.5 | A | A | A | B | |
| Example 15 | (1) | (S1) | 0.4 | A | A | A | B | |
| Example 16 | (1) | (S2) | 0.4 | A | A | A | B | |
| Example 17 | (1) | (S3) | 0.4 | A | A | A | B | |
| Example 18 | (1) | (S4) | 0.4 | A | A | A | B | |
| Example 19 | (1) | (S5) | 0.4 | A | A | A | B | |
| Example 20 | (1) | (S10) | 0.3 | A | B | C | C | |
| Example 21 | (1) | (S11) | 1.2 | A | B | C | C | |

TABLE 5

| | Developer | | | Evaluation at 5000th sheet (first) | | Evaluation at 10000th sheet (second) | | |
|---|---|---|---|---|---|---|---|---|
| | Toner particle | Surface-treated silica particle Type | Surface-treated silica particle Parts | Printed image evaluation | Thin-line reproducibility | Printed image evaluation | Thin-line reproducibility | Remarks |
| Comparative Example 1 | (2) | (SC1) | 0.5 | D | D | | | Occurrence of blurring at 5000th sheet |
| Comparative Example 2 | (2) | (SC2) | 0.5 | D (Occurrence of white stripe) | D | | | |
| Comparative Example 3 | (2) | (SC3) | 0.5 | C | C | D | D | |
| Comparative Example 4 | (2) | (SC4) | 0.5 | B | B | D | D | |
| Comparative Example 5 | (2) | (SC5) | 0.5 | D | D | | | |
| Comparative Example 6 | (2) | (SC6) | 1.2 | D | D | | | Occurrence of blurring at 5000th sheet |

The results described above indicate that the examples show good results in the evaluation of printed images and thin-line reproducibility. Also, in each of the examples, as a result of observation of the surface conditions of the development roller (development sleeve) after image output, good surface conditions are observed.

In particular, it is found that in Examples 1 to 5, 14, and 15 to 19 in which the silica particles having a compression and aggregation degree of 70% or more and 95% or less and a particle compression ratio of 0.28 or more and 0.36 or less are used as an external additive, evaluation of thin-line reproducibility is good as compared with the other examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A magnetic one-component developer comprising:

magnetic toner particles containing a binder resin and a magnetic powder; and silica particles having a compression and aggregation degree of 60% or more and 95% or less and a particle compression ratio of 0.20 or more and 0.40 or less, wherein the silica particles are surface-treated with a siloxane compound having a viscosity of 1,000 cSt or more and 50,000 cSt or less, and the surface adhesion amount of the siloxane compound is 0.01% by mass or more and 5% by mass or less.

2. The magnetic one-component developer according to claim 1, wherein the average equivalent circle diameter of the silica particles is 40 nm or more and 200 nm or less.

3. The magnetic one-component developer according to claim 1, wherein the particle dispersion degree of the silica particles is 90% or more and 100% or less.

4. The magnetic one-component developer according to claim 1, wherein the siloxane compound is silicone oil.

5. The magnetic one-component developer according to claim 1, wherein the binder resin contains a polyester resin.

6. The magnetic one-component developer according to claim 5, wherein the glass transition temperature (Tg) of the polyester resin is 50° C. or more and 80° C. or less.

7. The magnetic one-component developer according to claim 5, wherein the weight-average molecular weight (Mw) of the polyester resin is 5,000 or more and 1,000,000 or less.

8. The magnetic one-component developer according to claim 5, wherein the molecular weight distribution Mw/Mn of the polyester resin is 1.5 or more and 100 or less.

9. The magnetic one-component developer according to claim 1, wherein the binder resin contains a styrene-(meth) acrylic resin.

10. The magnetic one-component developer according to claim 9, wherein the copolymerization ratio (mass basis) of a styrene-based polymerizable monomer to a (meth)acrylic polymerizable monomer of the styrene-(meth)acrylic resin is 85/15 to 70/30.

11. The magnetic one-component developer according to claim 9, wherein the weight-average molecular weight of the styrene-(meth)acrylic resin is 30,000 or more 200,000 or less.

12. The magnetic one-component developer according to claim 9, wherein the glass transition temperature (Tg) of the styrene-(meth)acrylic resin is 50° C. or more and 75° C. or less.

13. The magnetic one-component developer according to claim 9, wherein the constituent component of the styrene-(meth)acrylic resin contains a crosslinkable monomer in addition to a styrene-based polymerizable monomer and a (meth)acrylic polymerizable monomer.

14. The magnetic one-component developer according to claim 13, wherein the copolymerization ratio (mass basis, crosslinkable monomer/whole monomer) of the crosslinkable monomer is 2/1000 to 30/1000.

15. The magnetic one-component developer according to claim 1, wherein the magnetic toner particles contain a mold release agent, and the mold release agent has a melting point of 50° C. or more and 110° C. or less.

16. The magnetic one-component developer according to claim 1, wherein the content of the magnetic powder is 35% by mass or more and 55% by mass or less relative to the toner particles.

17. A developer cartridge detachable from an image forming apparatus and comprising the magnetic one-component developer according to claim 1.

18. A process cartridge detachable from an image forming apparatus, the process cartridge comprising a development unit which contains the magnetic one-component developer according to claim 1 and which develops as a toner image an electrostatic image formed on the surface of an image holding member with the magnetic one-component developer.

* * * * *